US007862489B2

(12) United States Patent
Savšek et al.

(10) Patent No.: US 7,862,489 B2
(45) Date of Patent: Jan. 4, 2011

(54) MULTIPURPOSE EXERCISE SYSTEM

(75) Inventors: Zdenko Savšek, Zagorje ob Savi (SI); Sandi Ceško, Zagorje ob Savi (SI)

(73) Assignee: Studio Moderna SA, Lugano (CH)

( * ) Notice: Subject to any disclaimer, the term of this patent is extended or adjusted under 35 U.S.C. 154(b) by 536 days.

(21) Appl. No.: 11/789,661

(22) Filed: Apr. 24, 2007

(65) Prior Publication Data

US 2008/0015095 A1 Jan. 17, 2008

Related U.S. Application Data

(60) Provisional application No. 60/831,738, filed on Jul. 17, 2006.

(51) Int. Cl.
*A63B 21/02* (2006.01)
*A63B 22/00* (2006.01)
*A63B 69/06* (2006.01)

(52) U.S. Cl. ..... 482/121; 70/72

(58) Field of Classification Search ..... 482/121–126, 482/70–71, 51, 72–73
See application file for complete search history.

(56) References Cited

U.S. PATENT DOCUMENTS

| | | | | |
|---|---|---|---|---|
| 1,979,716 | A | 11/1934 | Terry | |
| 2,632,645 | A * | 3/1953 | Barkschat | 482/38 |
| 3,364,875 | A | 1/1968 | Bilaisis | |
| 3,374,782 | A | 3/1968 | Izzo | |
| 3,467,374 | A | 9/1969 | Auer | |
| 3,511,499 | A | 5/1970 | Schawalder | |
| 3,524,641 | A | 8/1970 | Ossenkop | |
| 3,547,434 | A | 12/1970 | Ossenkop | |
| 3,559,986 | A | 2/1971 | Ehrmantraut | |
| 3,591,172 | A | 7/1971 | Hude | |
| 3,650,528 | A | 3/1972 | Natterer | |
| 3,731,919 | A | 5/1973 | Schurch | |
| 3,791,645 | A | 2/1974 | Stelma | |
| 3,807,727 | A | 4/1974 | Ferguson | |
| 3,912,260 | A | 10/1975 | Rice | |
| 4,340,214 | A | 7/1982 | Schutzer | |
| 4,376,532 | A | 3/1983 | Hunstad | |
| 4,396,189 | A | 8/1983 | Jenkins | |
| 4,595,195 | A | 6/1986 | Miehlich | |
| 4,607,839 | A | 8/1986 | Knudson | |
| 4,650,184 | A | 3/1987 | Brebner | |

(Continued)

FOREIGN PATENT DOCUMENTS

| | | |
|---|---|---|
| CA | 2323170 A | 4/2002 |

(Continued)

*Primary Examiner*—Fenn C Mathew
(74) *Attorney, Agent, or Firm*—Mitchell P. Brook; Luce, Forward, Hamilton & Scripps LLP

(57) ABSTRACT

An exercise system is provided in which multiple exercise routines may be conducted with a single system. The exercise system may be used for skiing exercises, rowing exercises, and for weight training/resistance exercises. The system includes a housing that encloses a resistance assembly. A movable grip device and/or carriage interfaces with the resistance assembly so that movement of the grip device or carriage is resisted. The exercise system may include a concealment housing so that it may be stored in a compact and concealed position. The concealment housing may be an article of furniture or a portion of a structure to provide space saving benefits.

20 Claims, 30 Drawing Sheets

U.S. PATENT DOCUMENTS

| | | | | |
|---|---|---|---|---|
| 4,669,723 | A | 6/1987 | Arsenian | |
| 4,679,787 | A | 7/1987 | Guilbault | |
| 4,684,121 | A | 8/1987 | Nestegard | |
| 4,708,339 | A | 11/1987 | Perrine | |
| 4,730,826 | A | 3/1988 | Sudmeier | |
| 4,743,014 | A | 5/1988 | Loane | |
| 4,744,557 | A | 5/1988 | Smirmaul | |
| 4,783,069 | A | 11/1988 | Cottee | |
| 4,805,901 | A | 2/1989 | Kulick | |
| 4,813,667 | A | 3/1989 | Watterson | |
| 4,869,496 | A | 9/1989 | Colombo | |
| 4,911,430 | A | 3/1990 | Flament | |
| 4,913,423 | A | 4/1990 | Farran et al. | |
| 4,921,242 | A * | 5/1990 | Watterson | 482/72 |
| 4,951,942 | A | 8/1990 | Walden | |
| 4,953,853 | A | 9/1990 | Loane | |
| 4,993,704 | A | 2/1991 | Luczynski | |
| 5,020,793 | A | 6/1991 | Loane | |
| 5,078,389 | A | 1/1992 | Chen | |
| 5,108,093 | A | 4/1992 | Watterson | |
| 5,125,880 | A | 6/1992 | Peters | |
| 5,147,257 | A | 9/1992 | Loane | |
| 5,222,928 | A | 6/1993 | Yacullo | |
| 5,279,532 | A | 1/1994 | Chen | |
| 5,316,530 | A | 5/1994 | Romer | |
| 5,328,427 | A | 7/1994 | Sleamaker | |
| 5,374,228 | A | 12/1994 | Buisman et al. | |
| 5,391,130 | A | 2/1995 | Green et al. | |
| 5,429,567 | A | 7/1995 | Gerschefske et al. | |
| 5,496,239 | A | 3/1996 | Kallman et al. | |
| 5,496,241 | A | 3/1996 | Sellers | |
| 5,503,609 | A | 4/1996 | Bull | |
| 5,665,033 | A | 9/1997 | Palmer | |
| 5,681,250 | A | 10/1997 | Hoover et al. | |
| 5,690,591 | A | 11/1997 | Kenmochi et al. | |
| 5,692,995 | A | 12/1997 | Alvarez et al. | |
| D392,005 | S | 3/1998 | Piaget | |
| D392,700 | S | 3/1998 | Piaget | |
| 5,749,811 | A | 5/1998 | Wilson | |
| 5,800,313 | A | 9/1998 | Yu | |
| 5,807,210 | A | 9/1998 | Devlin | |
| 5,813,947 | A | 9/1998 | Densmore | |
| 5,865,713 | A * | 2/1999 | Hsu | 482/72 |
| 5,868,654 | A | 2/1999 | Norian | |
| 5,989,163 | A * | 11/1999 | Rodgers, Jr. | 482/70 |
| 6,139,473 | A | 10/2000 | Koyama et al. | |
| 6,146,313 | A | 11/2000 | Whan-Tong et al. | |
| 6,146,316 | A | 11/2000 | Carolus et al. | |
| 6,231,484 | B1 | 5/2001 | Gordon | |
| 6,270,403 | B1 | 8/2001 | Watanabe et al. | |
| 6,280,366 | B1 | 8/2001 | Hsieh | |
| 6,368,254 | B1 | 4/2002 | Wall | |
| 6,508,744 | B1 | 1/2003 | Carolus | |
| 6,514,180 | B1 | 2/2003 | Rawls | |
| 6,514,181 | B1 | 2/2003 | Taylor | |
| 6,527,676 | B1 | 3/2003 | Frick et al. | |
| 6,569,064 | B1 | 5/2003 | Loane | |
| 6,582,300 | B2 | 6/2003 | Watanabe et al. | |
| 6,767,313 | B2 | 7/2004 | Sayce | |
| 6,929,588 | B2 | 8/2005 | Hobson | |
| 7,037,247 | B1 * | 5/2006 | Bergeron | 482/148 |
| 2002/0016237 | A1 * | 2/2002 | Schmidt | 482/70 |
| 2003/0216230 | A1 | 11/2003 | Wang | |
| 2005/0049121 | A1 * | 3/2005 | Dalebout et al. | 482/93 |

FOREIGN PATENT DOCUMENTS

| | | | |
|---|---|---|---|
| CS | 272 923 | | 12/1991 |
| DE | 2908545 | A | 5/1980 |
| DE | 3707065 | | 9/1988 |
| DE | 3712982 | | 11/1988 |
| DE | 19748215 | C1 | 2/1999 |
| DE | 20110717 | U1 | 9/2001 |
| EP | 0116703 | A1 | 8/1984 |
| EP | 0207556 | A2 | 1/1987 |
| EP | 0576832 | B1 | 1/1994 |
| FR | 2 826 583 | | 1/2003 |
| GB | 834105 | | 5/1960 |
| GB | 876979 | | 9/1961 |
| GB | 902675 | | 8/1962 |
| GB | 984944 | | 3/1965 |
| GB | 1118083 | | 6/1968 |
| GB | 2 184 661 | A | 7/1987 |
| GB | 2 204 804 | A | 11/1988 |
| GB | 2 386 566 | | 9/2003 |
| IT | 1242299 | | 3/1993 |
| IT | 1244117 | | 7/1994 |
| JP | H05-091721 | | 12/1993 |
| JP | H06-091017 | | 4/1994 |
| JP | H06-105930 | | 4/1994 |
| JP | 06-134060 | | 5/1994 |
| JP | 08-308971 | | 11/1996 |
| JP | 3045397 | | 5/1997 |
| JP | 11-178968 | | 7/1999 |
| JP | 2001-46573 | | 2/2001 |
| JP | 2001-157726 | | 6/2001 |
| JP | 3079589 | | 6/2001 |
| JP | 2002-239050 | | 8/2002 |
| JP | 2003-000752 | | 1/2003 |
| PL | 175112 | B1 | 11/1998 |
| RO | 117763 | B | 7/2002 |
| SI | 9700201 | A | 2/1999 |
| SI | 20961 | | 2/2003 |
| SU | 1012928 | A | 4/1983 |
| WO | WO 89/09636 | | 10/1989 |
| WO | WO 91/06349 | | 5/1991 |
| WO | WO 01/02066 | A1 | 1/2001 |
| WO | WO 03/047704 | A1 | 6/2003 |

* cited by examiner

MULTIPURPOSE EXERCISE SYSTEM

CROSS REFERENCE TO RELATED APPLICATION

Priority is claimed to Provisional Patent Application Ser. No. 60/831,738, filed Jul. 17, 2006, the contents of which are incorporated herein by reference.

FIELD OF THE INVENTION

The present invention relates to an exercise system and apparatus that can be configurable for multiple types of exercise.

BACKGROUND OF THE INVENTION

Numerous types of exercise devices exist, such as treadmills, stationary bicycles, stair machines, rowing machines, ski trainers, weight machines and so on. People wishing to exercise may select to purchase one or more of such devices, or may go to a gym exercise apparatus may be available for use. Gym exercise suffers various deficiencies such as excessive time for traveling to and from the gym, crowds, lines, open hours and potential cleanliness concerns.

Home exercise equipment is known, and provides for the convenience of exercising at home, addressing some deficiencies of gym exercise. However, home exercise equipment also suffers various deficiencies. One such deficiency concerns the requirement of excessive space to position and use the equipment, which diminishes the desirability of positioning exercise equipment in apartments and houses. This deficiency is exacerbated if more than one exercise machine is desired such as for different types of exercise. Of course space constraints are not just limited to home exercise, as gyms also are space limited in the number and types of exercise machines that can be fit into their available space.

Another deficiency of many known exercise devices is that they are specialized for a particular type of exercise. For example, treadmills are directed towards jogging or walking types of exercise. Weights or weight machines are directed towards weight training exercises. Rowing machines are directed towards rowing or pulling exercises. Stair machines are directed towards climbing exercises. Cross-country ski machines are directed to linear or rotary types of cross-country skiing exercises. Traverse ski machines are limited to side-to-side types of ski exercises. Thus, a person wishing to engage in multiple home exercises may need to acquire multiple pieces of exercise equipment, taking up home space. A gym seeking to provide a wide range of exercises needs to purchase and position many different types of machines, also occupying available space. Aside from the space limitations, installing multiple machines also engenders other deficiencies such as time required for set-up, specialized training of gym personnel, learning period for users, maintenance and cleaning.

Accordingly, there is a need for an exercise system that is relatively compact, that can be stored under or within furniture, and that optionally can be used for more than one type of exercise.

SUMMARY OF THE INVENTION

The present invention provides an exercise system and apparatus that is capable of providing multiple types of exercises using a relatively compact mechanism. In one aspect of the invention, the exercise apparatus is has a relatively thin profile, but still enables more than one type of exercise. In another aspect of the invention, the relatively thin profile of the exercise apparatus allows it to be incorporated into furniture, such as a sofa or cabinet drawer as an exercise system. In a further aspect of the invention, the exercise apparatus combines several types of exercise into a single unit, such as traverse skiing, rowing and/or weight resistance training.

In an embodiment, a housing is provided that is generally rectangular. Within the housing is a resistance assembly that provides resistance when a user moves a grip device or carriage. The resistance assembly includes a tension transmission member that is configured in a predetermined geometry by tension redirecting member, and tensioning members, such as springs, that provide a preload tension to the tension transmission member. In an embodiment, the tension transmission member may be a cable and the tension redirecting members may be pulleys.

At least one tension adjustment member interfaces with the tension transmission member to alter the geometry of the tension transmission member responsive to movement of the grip device or carriage by the user.

The carriage is provided on the exterior of the housing, is translatable and may be used in various exercises, such as for rowing types of exercise, or as a foot support for skiing types of exercises. In addition, optional attachments are provided that allow additional components to be mounted to the housing, such as a railing or support that may be used to assist a user with balance or in reciprocating exercises. The resistance assembly may be adjusted to alter the resistance provided to a user during exercise.

The resistance assembly may be adjustable to vary the neutral position of the range of travel of the tension adjustment member, e.g., a mounting assembly. For example, a configuration of the system results in the tension adjustment member having a neutral position near the center of a range of travel. In this configuration, as the tension adjustment member is moved in either direction, it encounters resistance acting to induce it back to the neutral position provided by the resistance assembly. This configuration may be desired when the device is used as a ski exercise machine. In another example of a configuration of the system, the tension adjustment member has a neutral position at or near one end of its range of travel. This configuration may be desired when using the device as a rowing exercise machine.

In an embodiment, the grip device is coupled to a pull cable that extends from the machine, and includes something to grasp, such as a bar or handle. This configuration is desired for use in weight training. In weight training, a user may pull on the grip device to experience resistance from the resistance assembly.

The amount of resistance is adjustable by adjusting the applicable spring force by operating an adjustment mechanism. The mechanism optionally is accessible at least in part on the outside of the housing for ease of adjustment. The resistance is adjusted using a controller, such as by rotating a knob, operating a slider or operating an electronic or digital controller.

The exercise apparatus may be incorporated into an integrated exercise system. The integrated exercise system includes an exercise apparatus that may be stored and concealed within a concealment housing. The concealment housing may be an article of furniture so that when the exercise apparatus is stored and concealed it does not take away usable space. For example, the concealment housing may be a dresser cabinet and the exercise apparatus may be included instead of a drawer or inside of a drawer. In one example, the exercise apparatus is positioned in a bottom drawer for easy access in or near the operating position.

In operation, the exercise apparatus may be taken out of a stored and concealed position within a concealment housing out and used. Optionally, the exercise apparatus is connected to the concealment housing via a linkage that is manually actuated or motorized to position the exercise device in an operational position. For example, the exercise apparatus may be incorporated in a sofa structure. In such an example, the exercise apparatus may be folded out of the sofa using linkages or may be lifted from a space within the sofa, or alternatively can be operated in place by removing covering cushions. In another example, the exercise apparatus is positioned in a wall space, hinged near or at the floor and accessible by rotating it downwards. Likewise, the exercise apparatus can otherwise be stored in a small area, such as under a bed.

These and other features and advantages of the present invention will be appreciated from review of the following detailed description of the invention, along with the accompanying figures in which like reference numerals refer to like parts throughout.

DETAILED DESCRIPTION OF THE INVENTION

In the following paragraphs, the present invention will be described in detail by way of example with reference to the accompanying figures. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
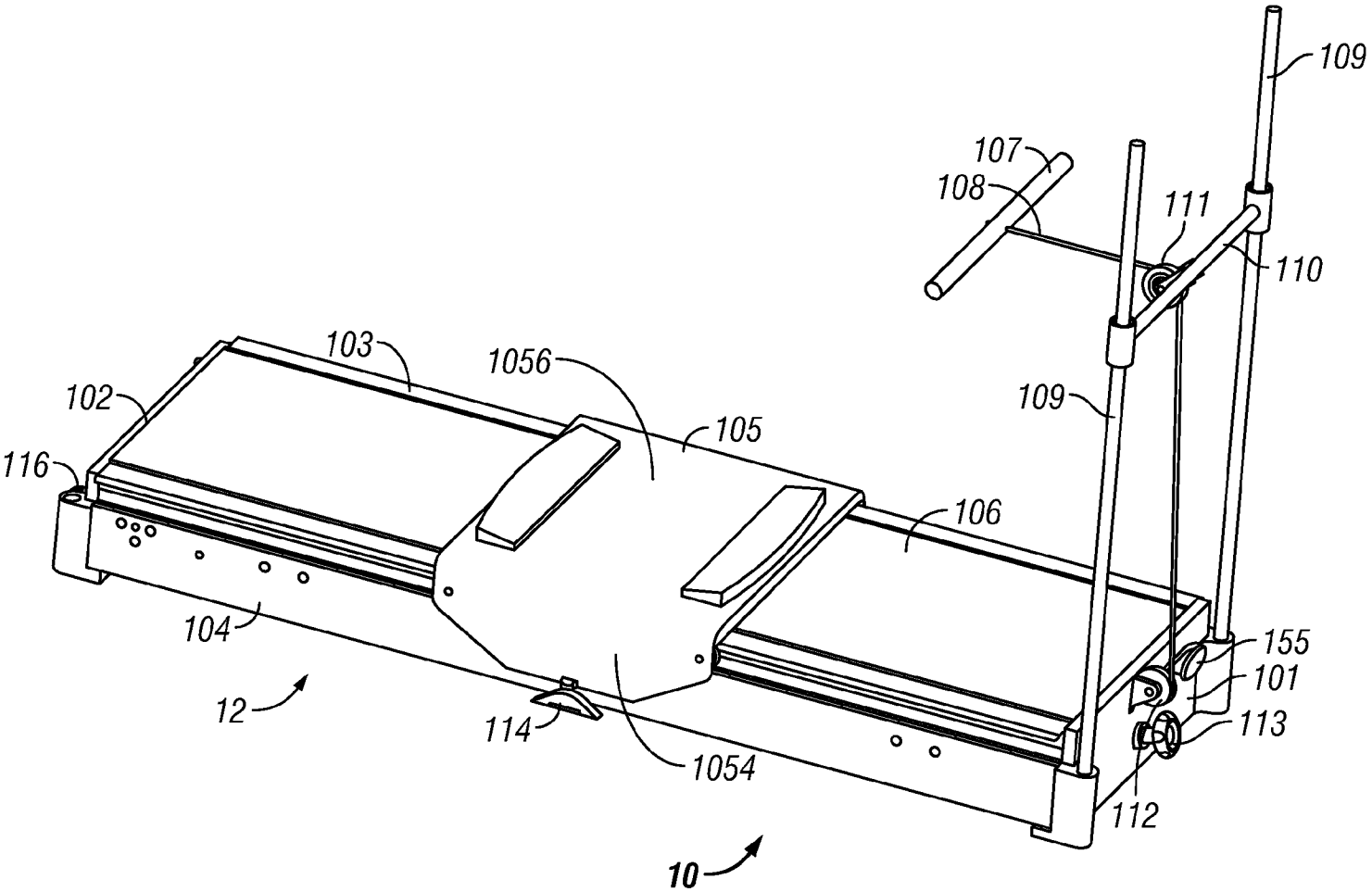
FIG. 1 is a perspective view of an embodiment of an exercise apparatus in a first configuration accordance with the present invention.
Figure 2:
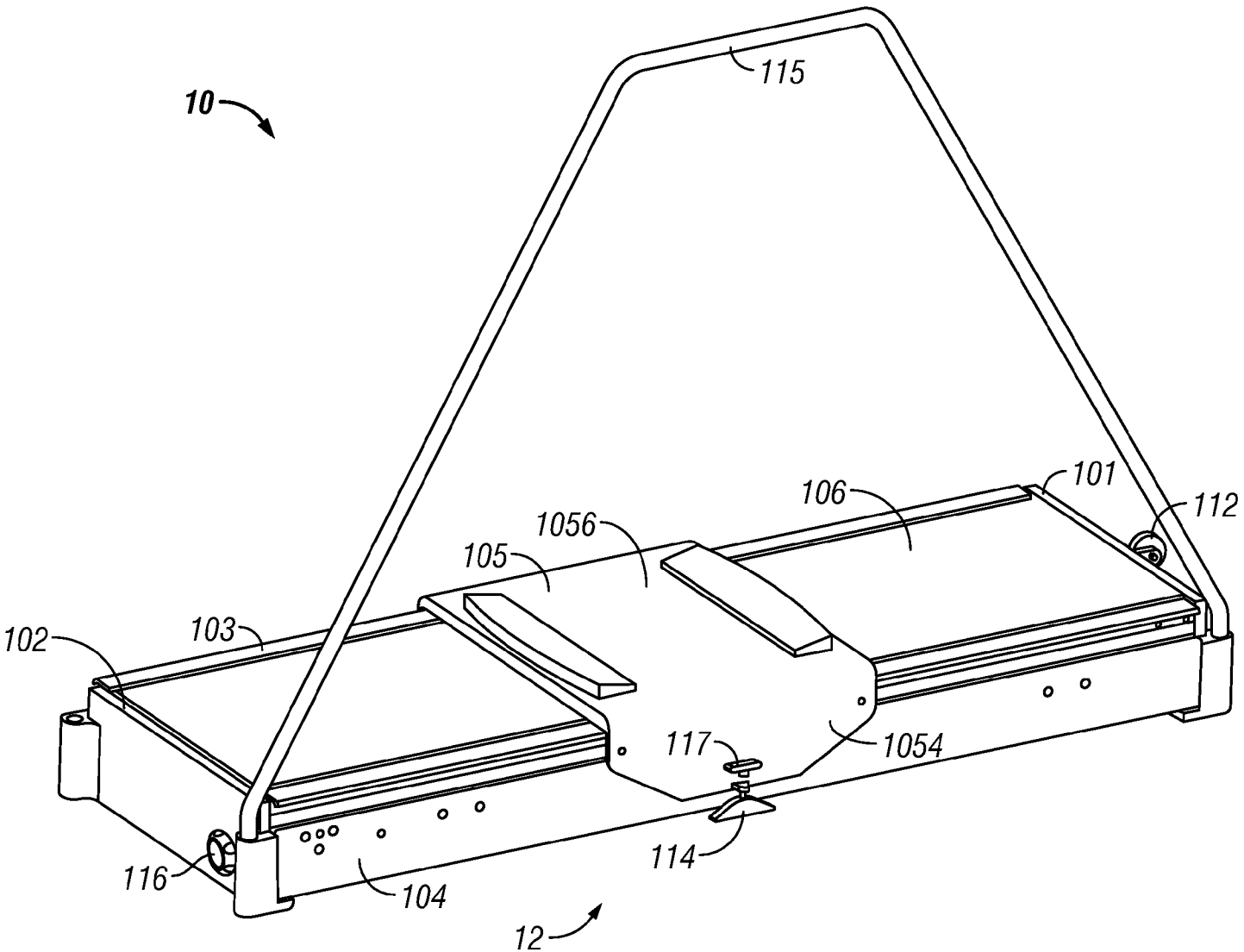
FIG. 2 is a perspective view of the exercise apparatus of FIG. 1 in a second configuration in accordance with the present invention.

The multipurpose exercise system of the present invention is generally constructed from an exercise apparatus that may be stored and concealed in a concealment housing, thereby integrating the exercise apparatus into an integrated exercise system, which may, for example, be in the form of a piece of household furniture. FIGS. 1 through 11 depict an embodiment of exercise apparatus 10 in accordance with an aspect of the present invention. Exercise apparatus 10 is generally constructed to allow the user to accomplish a variety of exercises using a single compact system. In particular, exercise apparatus 10 may be configured as shown in FIG. 1, which allows a user to perform rowing or weight resistance exercises by pulling grip device 107 against resistance provided by a resistance assembly included in exercise apparatus 10. Alternatively, exercise apparatus 10 may be configured as shown in FIG. 2, which allows a user to perform exercises that simulate downhill skiing or the like by sliding carriage 105 transversely against resistance provided by a resistance assembly included in exercise apparatus 10. In the present embodiment, cable, pulley and spring components are assembled to form the resistance assembly that is employed to provide resistance during exercise.

Housing 12 encloses the cable and spring components of the resistance assembly of exercise apparatus 10. Housing 12 is bound by first side panel 101, second side panel 102, third side panel, 103, fourth side panel 104, top cover 106, and an optional bottom cover (not shown). As shown, housing 12 may be rectangular with first side panel 101 and second side panel 102 being generally parallel and forming the shortest sides of the rectangular housing 12. Third side panel 103 and fourth side panel 104 are generally parallel and form the elongate sides of rectangular housing 12, which are parallel to a longitudinal axis of housing 12.

Top cover 106 preferably extends across the area bounded by the side panels of housing 12 so as to obscure the interior of housing 12, and to provide a pleasing appearance and durable enclosure. Optionally, cover 106 may be configured so that it is movable relative the other housing components so that the interior of housing 12 may be accessed. For example, cover 106 may be hinged to one of side panels 101, 102, 103 or 104 or removable from housing 12.

In a preferred embodiment, cover 106 also is sufficiently strong when mounted and in a closed position to support the weight of a typical user, such as between 100 lbs. and 500 lbs. When closed, cover 106 helps prevent access to the interior of housing 12 to shield the operative and moving components of the cable and spring assembly, and provides a support surface for a user during exercises.

Additional supporting members, such as connector 118 and connector 119, extend between third side panel 103 and fourth side panel 104 to provide additional support to housing 12. Connectors 118 and 119 are located so that they may also be used to mount components of the resistance assembly while not interfering with the operation of the resistance assembly. For example, a tension transmission member, such as resistance cable 130, of the resistance assembly extends both above and below connector 119, and connector 119 supports pulley 132 that is included in the resistance assembly.

Additionally, barrier 126 may be included that provides separation between at least a portion of the components within the interior of exercise apparatus 10. Barrier 126 may prevent undesired interaction between the interior components or added protection to a user during maintenance of the device. Barrier 126 may also increase the rigidity of housing 12 alone or in combination with connectors 118 and 119.

Figure 3:
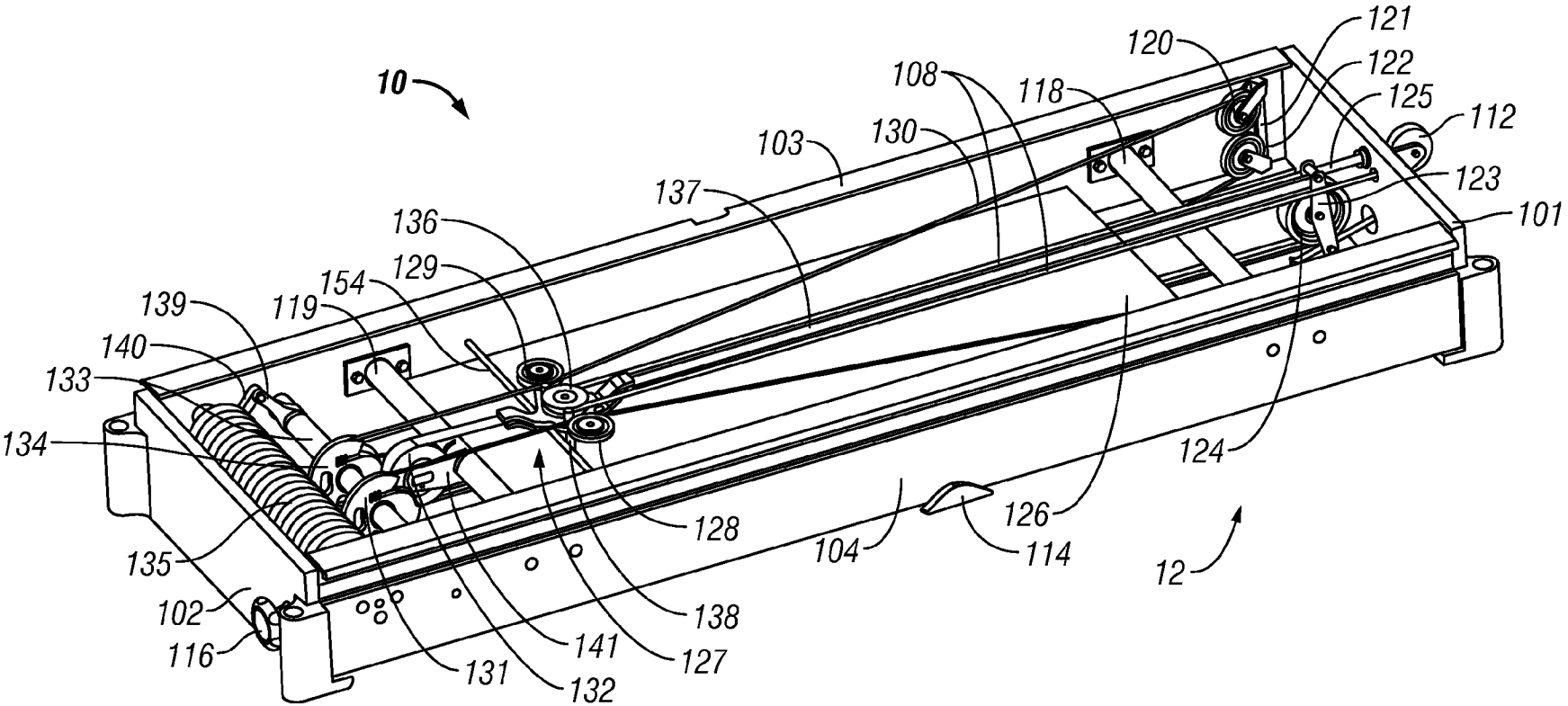
FIG. 3 is a perspective view of a portion of the exercise apparatus of FIG. 1.

The resistance assembly will be described with reference to FIGS. 3 and 4 in which various components of housing 12 have been removed such as top cover 106. Generally, the resistance assembly comprises a tension transmission member, e.g., resistance cable 130, which extends through housing 12 with a predetermined geometry via a plurality of tension redirection members, e.g., pulleys. A tensioning member, e.g., torsion spring 135, is coupled to resistance cable 130 so that it is preloaded with a selected tension. At least one tension adjustment member is coupled to resistance cable 130 and configured so that movement of the tension adjustment member along resistance cable 130 causes a change in the tension applied to resistance cable 130 by torsion spring 135. It should be noted that the term "pulley" herein is used to indicate any form of tension redirection member or assembly.

In the present embodiment, a first end of resistance cable 130 is coupled to first disk 131. Resistance cable 130 extends from first disk 131, generally toward first side panel 101, past pulley 128 disposed on mounting assembly 127. Mounting assembly 127 is an example of a tension adjustment member and is movable relative to housing 12, as will be described in greater detail below, to change the geometry of resistance cable 130. The interaction of resistance cable 130 with pulley 128 redirects resistance cable 130 from an orientation generally parallel to the longitudinal axis of housing 12 to an angled orientation wherein resistance cable 130 extends generally toward the intersection of side panel 101 and side panel 104.

Resistance cable 130 extends from pulley 128 to pulley 147, which is disposed generally adjacent the intersection of panel 101. Pulley 147 redirects resistance cable 130 vertically downward for a short distance to pulley 149. Pulley 149 redirects resistance cable 130 to pulley 143, which is disposed on attachment 142, another example of a tension adjustment member.

Resistance cable 130 extends from pulley 143 of attachment 142 to pulley 150, which is generally horizontal and generally disposed adjacent an intersection of side panel 102 and side panel 104. From pulley 150, resistance cable 130 extends generally parallel to side panel 102 to pulley 151, which is disposed adjacent an intersection of side panel 102 and side panel 103. Resistance cable 130 then extends from pulley 151 to pulley 144 of attachment 142.

Resistance cable 130 proceeds from pulley 144 to pulley 122 generally disposed adjacent an intersection of side panel 101 and side panel 103. Pulley 122 redirects resistance cable 130 vertically upward to pulley 120. Finally, resistance cable 130 proceeds from pulley 120, away from side panel 103, to pulley 129 disposed on mounting assembly 127, and then toward side panel 102. Resistance cable 130 terminates at second disk 134.

Pulley 120, pulley 122, pulley 147 and pulley 149 are mounted in housing 12 in pairs that are configured to redirect resistance cable 130 vertically. Additionally, pulleys 120 and 122 are mounted so that they are capable of moving relative to each other. Similarly, pulleys 147 and 149 are mounted in housing 12 so that they are capable of moving relative to each other. As shown, pulley 120 and pulley 122 are mounted in housing 12 so that they are able to rotate relative to each other about a first vertical axis that extends along axle 121. Pulley 147 and pulley 149 are likewise mounted in housing 12 so that they are able to rotate relative to each other about a second vertical axis that extends along axle 148.

Figure 4:
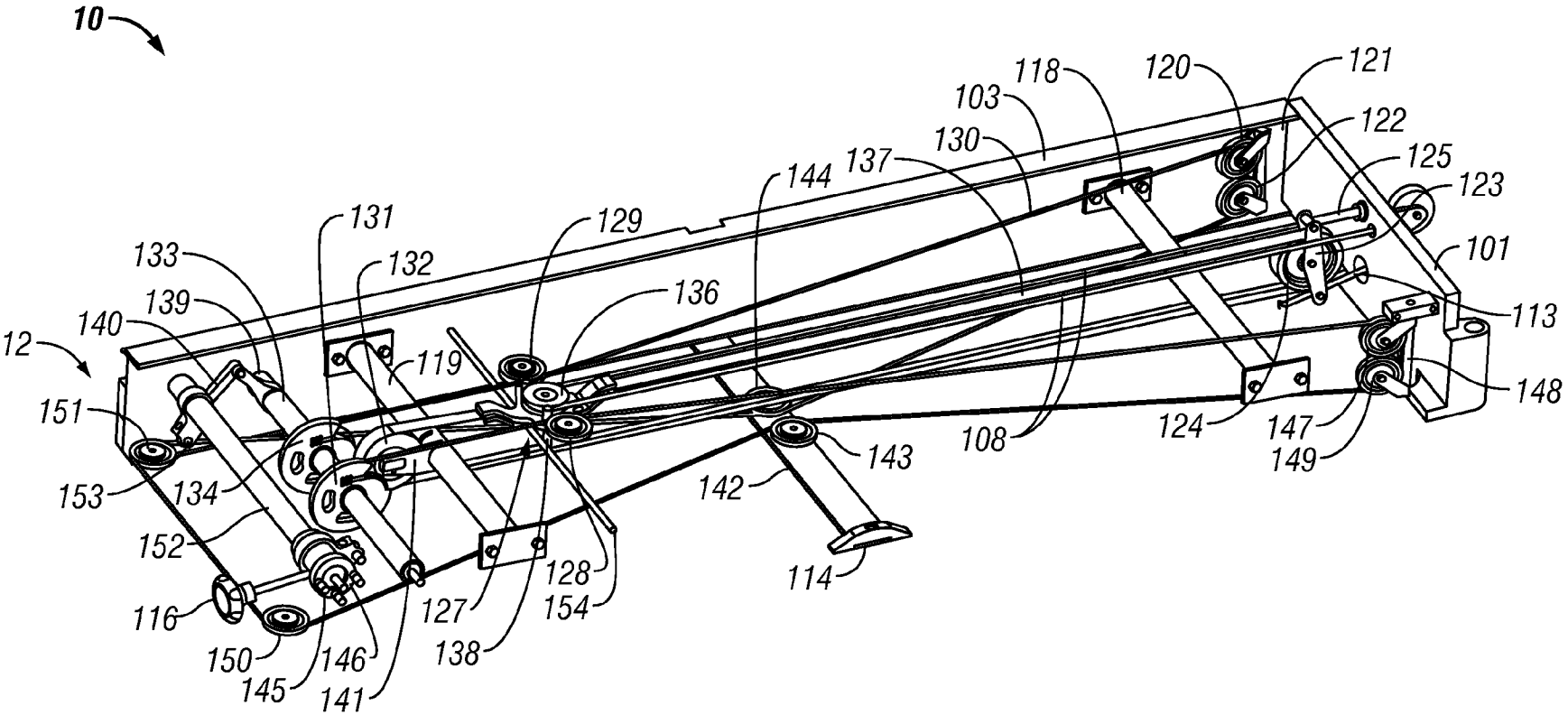
FIG. 4 is a perspective view of another portion of the exercise apparatus of FIG. 1.

As shown in FIG. 4, resistance cable 130 is configured so that it generally forms two levels. For example, the portions of resistance cable 130 extending between first disk 131, pulley 128 and pulley 147 is coplanar with the portions of resistance cable 130 extending between second disk 134, pulley 129 and pulley 120, thereby forming a first level. The second level is formed by the portions of resistance cable 130 extending between pulley 122, pulley 144, pulley 151, pulley 150, pulley 143 and pulley 149, which are also coplanar.

The first level of resistance cable 130 is generally shaped in a "Y" configuration and the second level is generally shaped in an "X" configuration. As will be described in greater detail below, the first level of resistance cable 130 is particularly well suited to providing resistance for rowing or weight training type exercises, while the second level is particularly well suited to providing resistance for exercises involving movement in opposite directions from an intermediate neutral position, such as skiing type exercises.

Resistance cable 130 is connected at one end to first disk 131 and at a second end to second disk 134. Preferably, first disk 131 is positioned such that the path followed by resistance cable 130 between first disk 131 and the contact point with pulley 128 is aligned substantially parallel to the reciprocating path of mounting assembly 127. Similarly, second disk 134 is positioned such that the path followed by resistance cable 130 between second disk 134 and the contact point with pulley 129 is substantially parallel to the reciprocating path of mounting assembly 127.

Torsion spring 135 is employed to preload resistance cable 130 and to react to increased tension in resistance cable 130 that results from movement of the tension adjustment members during use of exercise apparatus 10. Torsion spring 135 is coupled to resistance cable 130 through a resistance linkage formed by first disk 131, second disk 134, support 133, linkage 139, coupler 140 and support 152. Resistance linkage converts tension in resistance cable 130 into rotational displacement of an end of torsion spring 135. In particular, as resistance cable 130 exerts a force on first disk 131 and second disk 134, support 133 rotates which causes an end of torsion spring 135 to rotate via linkage 139 and coupler 140, thereby creating a spring force to counter at least a portion of the increased tension in resistance cable 130.

First disk 131 and second disk 134 are attached to support 133. In the present embodiment, first disk 131 and second disk 134 are fixedly coupled to support 133 and support 133 is coupled to fourth side panel 104 and third side panel 103 so that it may rotate. Support 133 is connected to torsion spring 135 by linkage 139 and coupler 140. Preferably, linkage 139 is fixedly attached to support 133 and coupled to a first end of coupler 140 via a pin, hinge, or other type of connection that allows relative motion.

The second end of coupler 140 is coupled to attachment 153, which is disposed on support 152. Coupler 140 is configured so that rotation of support 133 is transmitted to attachment 153, thereby causing attachment 153 to rotate. Support 152 is disposed between fourth side panel 104 and third side panel 103 of housing 12 and may rotate relative to the side panels. One end of support 152, located near side panel 104, is disposed within an opening in flange 145. The other end of support 152 is coupled to side panel 103. Attachment 153 is affixed to support 152 in the vicinity of side panel 103 and is coupled to coupler 140 with a pin, hinge, or other type of connection that allows relative motion.

Flange 145 is disposed about an end of support 152 and is attached to fourth side panel 104. Flange 145 is also coupled to attachment 146, which may rotate about flange 145. Attachment 146 is coupled with knob assembly 116, such that adjustment of knob assembly 116 varies the angular position of attachment 146.

Torsion spring 135 encircles support 152. One end of torsion spring 135 is attached to attachment 146, whereas the other end of torsion spring 135 is attached to attachment 153. As a result, forces that are communicated to attachment 153 from resistance cable 130 via disks 131 and 134, support 133, linkage 139 and coupler 140, cause one end of torsion spring 135 to rotate relative to the other end of torsion spring 135. Thus, as support 133 is rotated due to increased tension of resistance cable 130, the force is communicated to torsion spring 135. As a result, torsion spring 135 is deflected and applies a return force that resists the deflection and acts to return support 133 to the earlier position. The spring force provided by torsion spring 135 provides resistance during use of exercise apparatus 10 when a tension adjustment member causes the tension in resistance cable 130 to increase.

It should be appreciated that the relationship between movement of the tension adjustment member, e.g., mounting assembly 127 and attachment 142, and resistance provided by the resistance assembly may be selected to provide desired operation characteristics. For example, the relationship may be linear or non-linear as desired. For example, disks 131 and 134 may be provided with a constant or varying diameter so that the moment arm provided between resistance cable 130 and support 133 changes based on the angular orientation of disks 131 and 134. The linkage mechanism used to transmit rotation of support 133 into rotation of attachment 153 and an end of torsion spring 135 may also be designed to provide any desired relationship between the motion of the tension adjustment member and resistance provided by the resistance assembly.

As shown in FIG. 1, exercise apparatus 10 may be configured to allow a user to perform rowing, weight resistance type exercises. In that configuration, optional grip device 107 may be included in exercise apparatus 10. A first end of a pull cable 108 is either permanently or removably attached to grip device 107. Pull cable 108 extends from grip device 107 and is redirected by pulley 111 vertically downward to pulley 112, which redirects pull cable 108 into housing 12 through side panel 101. After entering housing 12, pull cable 108 loops around pulley 136 disposed on mounting assembly 127 and is redirected back out of housing 12 through side panel 101. The second end of pull cable 108 is removably coupled to a spool 155 disposed on an outer surface of side panel 101.

It should be appreciated that grip device 107 may be any form of grip device that allows a user to grasp, push and/or pull the pull cable. Additionally, it should be appreciated that the pull cable may be any device that transmits movement of the grip device by the user, for example it may be a cable, wire, belt, rope, rod or any other structure capable of transmitting a tensile force or compressive force between the grip device and mounting assembly 127.

Mounting assembly 127 is configured to reciprocate in a direction generally parallel to the longitudinal axis of housing 12. In the present embodiment, mounting assembly 127 is suspended by belt 137. In particular, belt 137 forms a closed loop that extends around pulley 124 and pulley 132. Mounting assembly 127 is fixedly coupled to belt 137 so that movement of mounting assembly 127 is limited to the path of belt 137. It should be appreciated that mounting assembly 127 may be coupled to two ends of belt 137, as shown, or it may be mounted over a portion of belt 137. It should be understood that mounting assembly 127 translates over a limited portion of the loop created by belt 137, preferably limited to a predetermined path between pulley 124 and pulley 132. Alternatively, mounting assembly 127 may be configured to roll or glide along a track rather than being mounted to belt 137 if desired.

Mounting assembly 127 supports pulley 128, pulley 129 and pulley 136. As described above, pulleys 128 and 129 engage a portion of the first level of resistance cable 130 and pulley 136 engages a portion of pull cable 108. As a result, mounting assembly 127 provides force transmission between grip device 107 and the resistance assembly of exercise apparatus 10. As will be discussed in greater detail below, movement of mounting assembly 127 along the path of belt 137 changes the geometry of resistance cable 130 which changes the amount of tension in resistance cable 130 and the amount of resistance applied to grip device 107 by the resistance assembly.

Pulleys 128 and 129 are located on mounting assembly 127 so that they direct resistance cable 130 into the "Y" shape of the first level. In particular, pulleys 128 and 129 are positioned on mounting assembly 127 so that the portion of resistance cable 130 extending between pulley 128 and first disk 131 and the portion extending between pulley 129 and second disk 134 are approximately parallel to the longitudinal axis of housing 12. Additionally, pulleys 128 and 129 are positioned so that they are closer to the longitudinal centerline of housing than pulleys 120 and 147. As a result, the portions of resistance cable 130 extending from mounting assembly 127 toward side panel 101 also extend laterally outward toward side panels 103 and 104.

It will be appreciated that the "Y" shaped configuration of the first level of resistance cable 130 formed by the interaction of mounting assembly 127 and resistance cable 130 causes mounting assembly 127 to be induced toward side panel 102. In particular, the preload tension of resistance cable 130 forces mounting assembly generally in the direction of side panel 102.

Movement of mounting assembly 127 toward side panel 101 by a user, such as by pulling grip device 107, changes the geometry of the first level of resistance cable 130, thereby increasing the tension in resistance cable 130 and increasing the force applied to mounting assembly 127 in the direction of side panel 102. It will further be appreciated that as used herein, the description of the first level of resistance cable 130 as a "Y" shape is intended to encompass the configuration of first level approaching a "V" shape as mounting assembly 127 is drawn closer to side panel 102.

As described above, belt 137 is looped around pulley 124 and pulley 132. Pulley 124 is rotatably coupled to pendulum 123, which is coupled to axle 125. Axle 125 is attached to side panel 101 and extends toward the interior of 20 and pivotally supports a portion of pendulum 123 so that pendulum may be rotated about the end of axle 125. Pendulum 123 also is coupled to knob assembly 113 at a location spaced from the pivot connection of pendulum 123 to axle 125. Knob assembly 113 is configured such that rotation of knob assembly 113 in a predetermined direction causes pendulum 123 to rotate about the pivot connection with axle 125. The rotation of pendulum changes the distance between pulley 124 and pulley 132, thereby altering the tension of belt 137. By altering the tension of belt 137, the amount of resistance applied to grip device 107 is altered.

Pulley 132 is coupled to pulley mount 141, which is affixed to connector 119. Pulley mount 141 is located on connector 119 so that pulley 132 is generally aligned with pulley 124 along an axis that is parallel to the longitudinal axis of housing 12. In accordance with one aspect of the present invention, pulley mount 141, pulley 132, pulley 124, and belt 137 are located approximately midway between fourth side panel 104 and third side panel 103.

Pulleys 124 and 132 are located so that first disk 131 is located closer to side panel 104 than belt 137 and so that second disk 134 is closer to side panel 103 than belt 137. Additionally, pulleys 124 and 132 are located so that belt 137 is equidistant from first disk 131 and second disk 134.

Pulley 136 is rotatably coupled to mounting assembly 127. Pulley 136 is configured to rotate about an axis that is generally perpendicular to the longitudinal axis of housing 12. For example, in the present embodiment, pull cable 108 forms a loop within housing 12 that is disposed within a horizontal plane. The axis of rotation of pulley 136 is vertical so that pull cable 108 may easily engage pulley 136. It should be appreciated that the axis of rotation of pulley 136 will generally be normal to the plane of the portion of pull cable 108 within housing 12 which need not be horizontal. It will further be appreciated that other embodiments may omit pulley 136, such as where a first end of pull cable 108 is coupled to grip device 107 and a second end of pull cable 108 is directly coupled to mounting assembly 127.

The range of travel of mounting assembly 127 may be limited. For example, mounting assembly 127 includes spindle 138, which extends downward from mounting assembly 127. Spindle 138 may b configured to contact limit member 154, or another component, such as connector 119, thereby impeding motion of mounting assembly 127 at the desired endpoint of travel toward second side panel 102. Similarly, the range of motion of mounting assembly 127 may be limited by contact between spindle 138 and another body, such as connector 118, at the desired endpoint of travel toward first side panel 101.

Referring again to FIG. 1, vertical supports 109 are coupled to side panel 101 and provide framework for coupling pulley 111 to exercise apparatus 10. In the illustrated embodiment, vertical supports 109 are removably coupled at or near side panel 101 and may be used to mount horizontal support 110 and pulley 111. In accordance with one aspect of the present invention, horizontal support 110 may be attached to vertical supports 109 at a variety of elevations, such as with cotter pins, wing nuts, or other such devices. Accordingly, the height and orientation of pulley 111 may be adjusted to accommodate a range of users or workout programs so as to redirect the direction of the tension forces exerted through pull cable 108. For example, some weight resistance training exercises can be performed by positioning the pulley 111 at an elevated location and rowing types of exercises can be facilitated by positioning the pulley 111 at a relatively lower location easily accessible to a user from a sitting position on carriage 105 or top cover 106.

Figure 5:
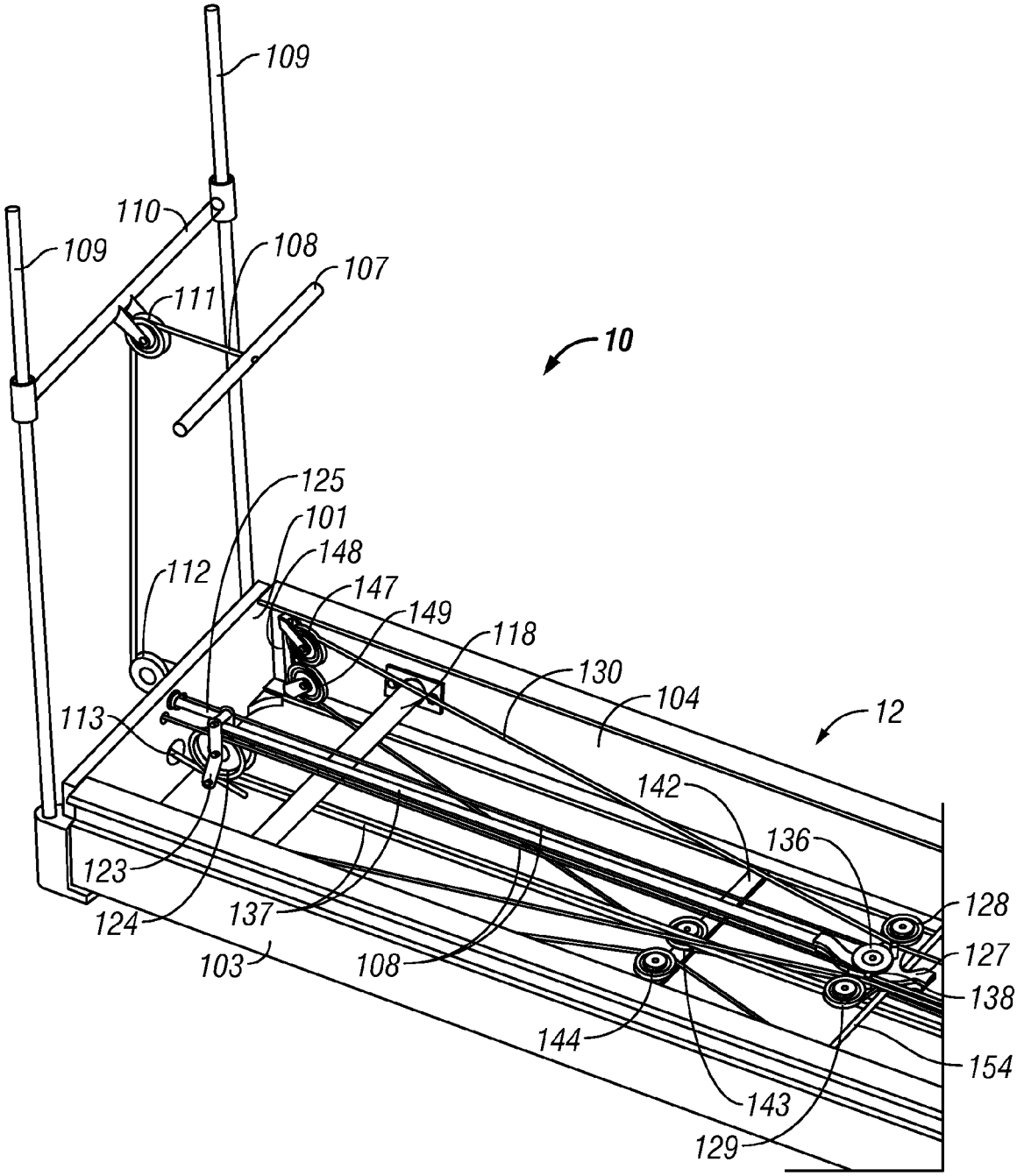
FIG. 5 is a perspective view of another portion of the exercise apparatus of FIG. 1.
Figure 6:
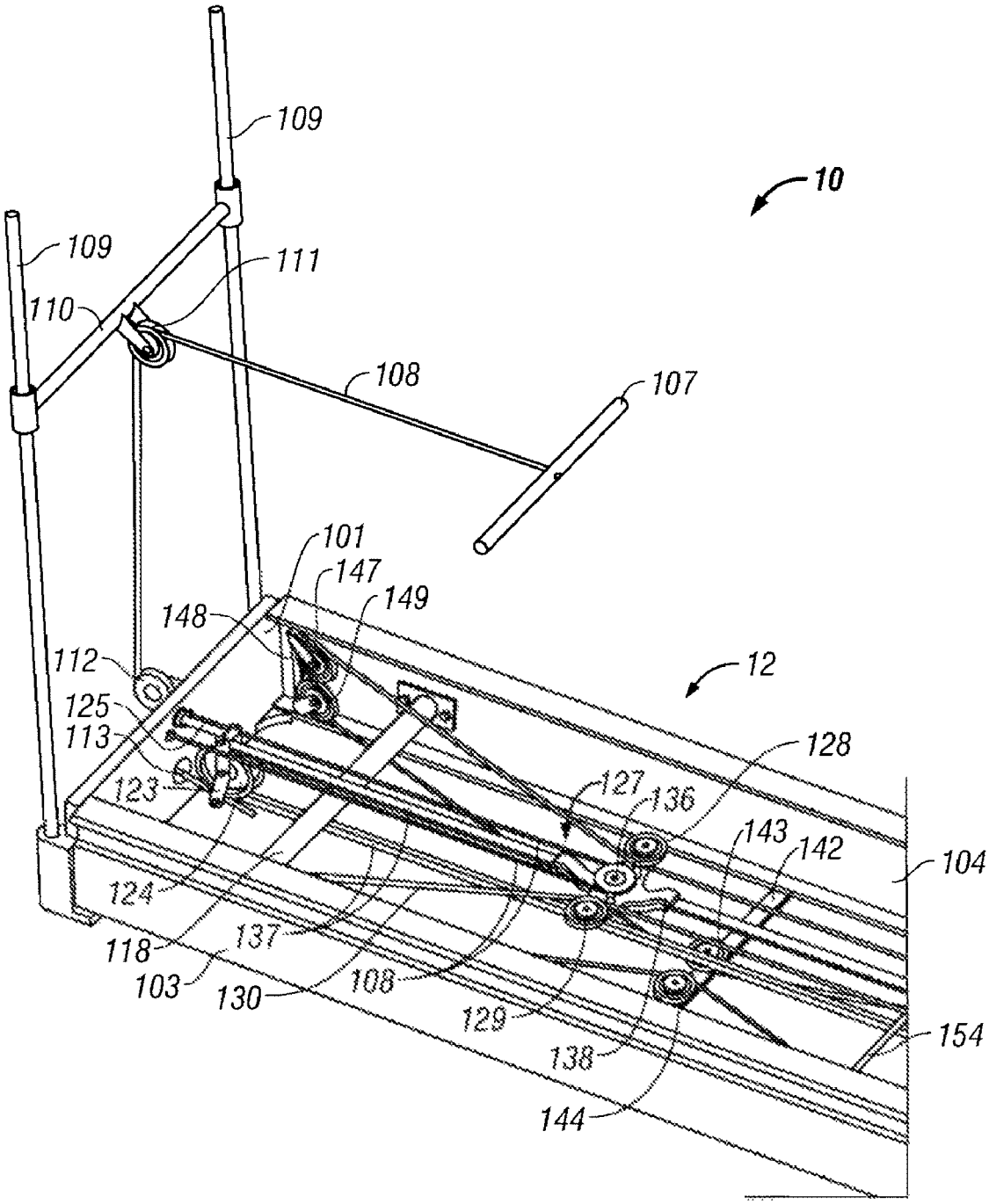
FIG. 6 is a perspective view of another portion of the exercise apparatus of FIG. 1.
Figure 7:
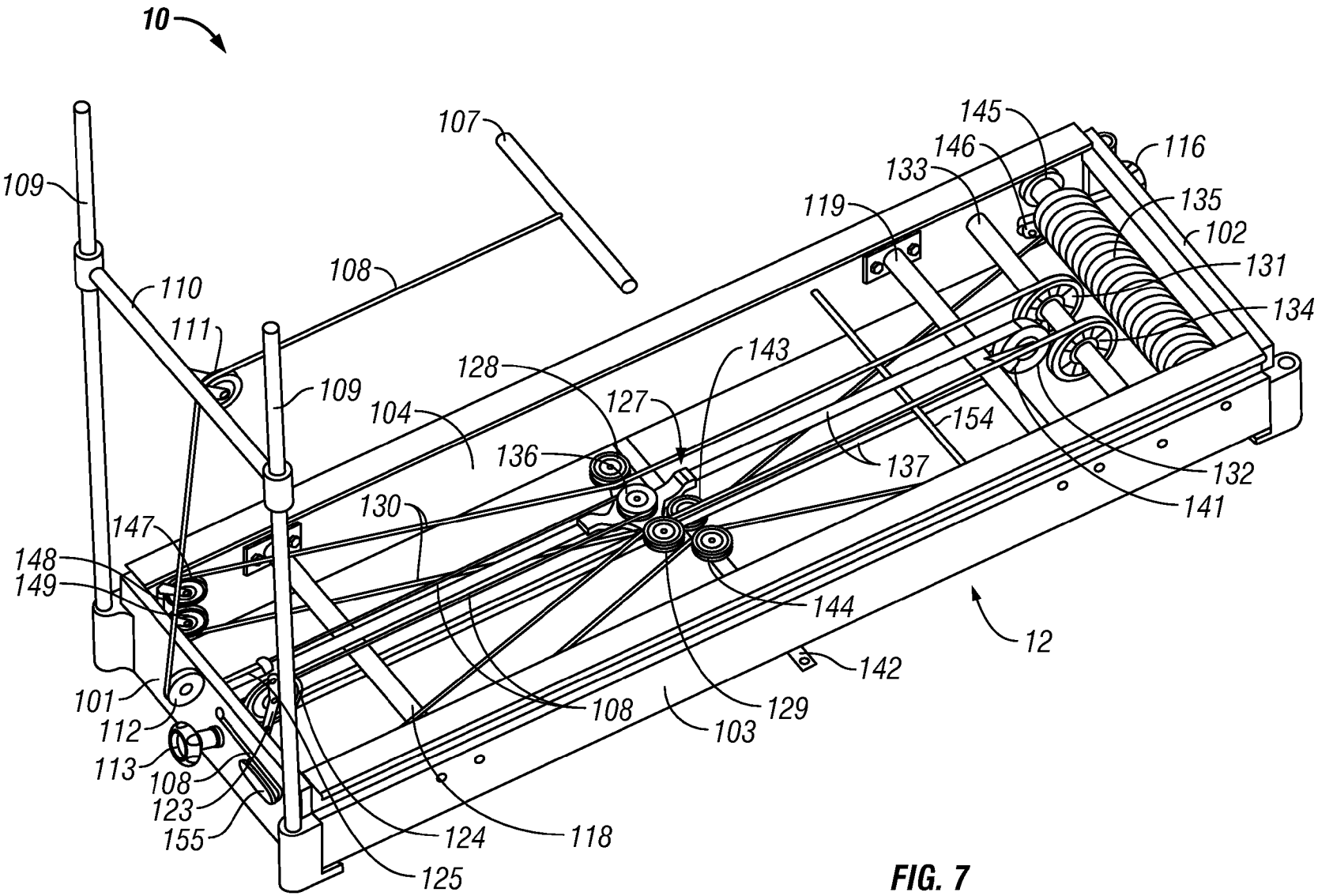
FIG. 7 is a perspective view of another portion of the exercise apparatus of FIG. 1 shown in the configuration of FIG. 6.

Referring to FIGS. 5-7, operation of exercise apparatus 10 in a weight resistance or rowing configuration will be described. In those figures, carriage 105, top cover 106 and barrier 126 have been removed for clarity, although each would preferably remain in place during normal operation of exercise apparatus 10. As a user applies a pulling force to grip device 107, a tensile force is transmitted along pull cable 108. As a result, a force is applied to mounting assembly 127 that induces movement of mounting assembly 127 toward first side panel 101. Resistance provided by the resistance assembly increases the force required to continue movement of mounting assembly 127. When the pulling force is decreased after mounting assembly 127 has been moved toward first side panel 101, the increased resistance provided by resistance assembly induces mounting assembly 127 to move back toward second side panel 102.

In FIG. 5, only a minimal amount of force has been applied to grip device 107. This force is applied as a horizontal load, and is sufficient to overcome the gravitational force and lift grip device 107, but is not sufficient to displace mounting assembly 127 from a point in which spindle 138 is in contact with member 154.

As the horizontal pulling force exerted on grip device 107 increases, mounting assembly 127 is moved closer to first side panel 101, as shown in FIGS. 6 and 7. The tension in resistance cable 130 is greater in FIGS. 6 and 7 as compared to FIG. 5 due to the change in geometry of resistance cable 130 caused by movement of mounting assembly 127 and the interaction between pulleys 128 and 129 and resistance cable 130. In particular, resistance cable 130 is forced to deflect such that a greater length of that resistance cable 130 is essentially parallel to the reciprocating path of mounting assembly 127 and a shorter length extends between mounting assembly 127 and pulleys 120 and 147 and at a greater angle. In contrast, as mounting assembly 127 moves toward second side panel 102, tension in resistance cable 130 is decreased.

Means for adjusting the amount of resistance provided by the resistance assembly are provided, thereby allowing a user to customize the level of difficulty or intensity of a workout. One manner of altering the amount of resistance applied by the resistance assembly during motion of grip device 107 is to adjust knob assembly 113. As mentioned above, as knob assembly 113 is adjusted, pendulum 123 is rotated which causes relative motion between pulley 124 and pulley 132. Because belt 137 forms a loop that passes over pulley 124 and pulley 132, the further pulley 124 is moved away from pulley 132, the greater the tension becomes in belt 137.

Pulley 132 optionally comprises a unidirectional clutch that allows pulley 132 to turn in only one direction. In particular, pulley 132 is configured to turn freely as mounting assembly 127 moves toward second side panel 102, but is prevented from rotating as mounting assembly 127 is moved toward first side panel 101. In this manner, as knob assembly 113 is adjusted to increase tension in belt 137, greater force must be applied to grip device 107 in order to move mounting assembly 127 a given distance toward first side panel 101. Increased force is required because that force must overcome the friction provided between belt 137 and pulley 132 to cause belt 137 to slide over the stationary pulley 132. Because pulley 132 is free to rotate in the opposite direction, mounting assembly 127 may move toward second side panel 102 and return to its original position when the pulling force applied to grip device 107 is reduced.

Another manner of altering the amount of resistance applied by the resistance assembly during motion of grip device 107 is to adjust knob assembly 116. As described above, attachment 146 is coupled to knob assembly 116 such that adjustment of knob assembly 116 varies the angular position of attachment 146. Because an end of torsion spring 135 is coupled to attachment 146, altering the angular position of attachment 146 may be used to alter the preload applied by torsion spring 135 to resistance cable 130. Increasing the preload increases the resistance applied by the resistance assembly while reducing the preload reduces the resistance applied by the resistance assembly.

Figure 8:
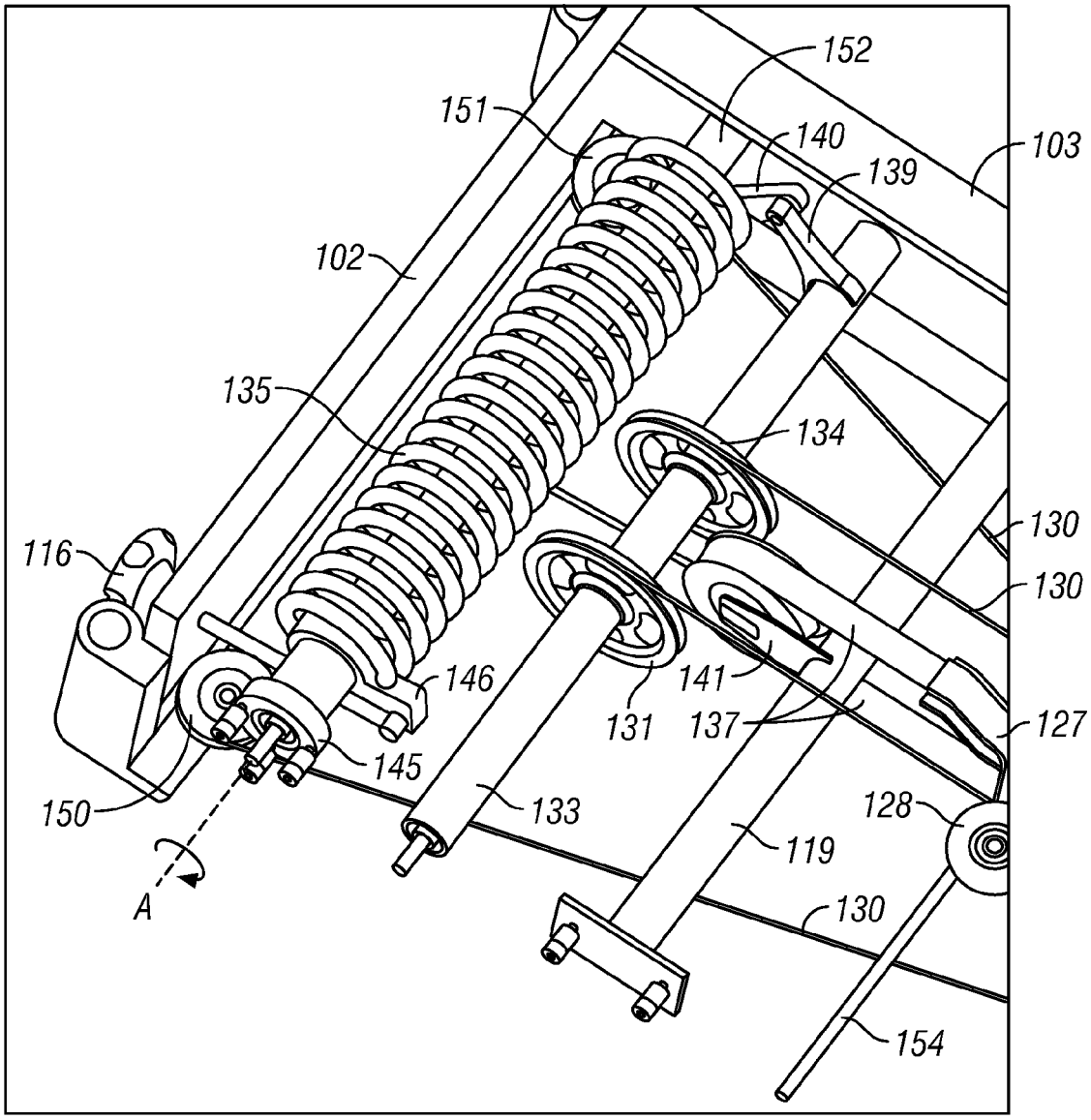
FIG. 8 is a perspective view of another portion of the exercise apparatus of FIG. 1.

Referring to FIG. 8, a partial view of exercise apparatus 10 is described. In accordance with one aspect of the present invention, one end of knob assembly 116 is disposed on an outer side of side panel 102, so that a user may manipulate knob assembly 1 16. A portion of knob assembly 116 passes through an opening in side panel 102, and a second end of knob assembly 116 is coupled to attachment 146. Knob assembly 116 is configured to adjust the position of attachment 146. The adjustment may be accomplished by providing attachment 146 and the second end of knob assembly 116 with screw threads. Hence, as knob assembly 116 is turned, attachment 146 travels along the length of knob assembly 116. Alternatively, the adjustment may be accomplished by attaching knob assembly 116 to attachment 146 with a pin, hinge, or other movable mechanism and providing screw threads along knob assembly 116 and the opening in side panel 102. It will be appreciated that other manners of accomplishing this adjustment are possible and are intended to fall within the scope of the present invention.

In the configuration depicted in FIG. 8, as knob assembly 116 is adjusted in a manner to increase resistance, attachment 146 is rotated around flange 145 in a direction labeled A. Because one end of torsion spring 135 is attached to attachment 146, a force is applied to torsion spring 135 inducing it to rotate in direction A.

Figure 9:
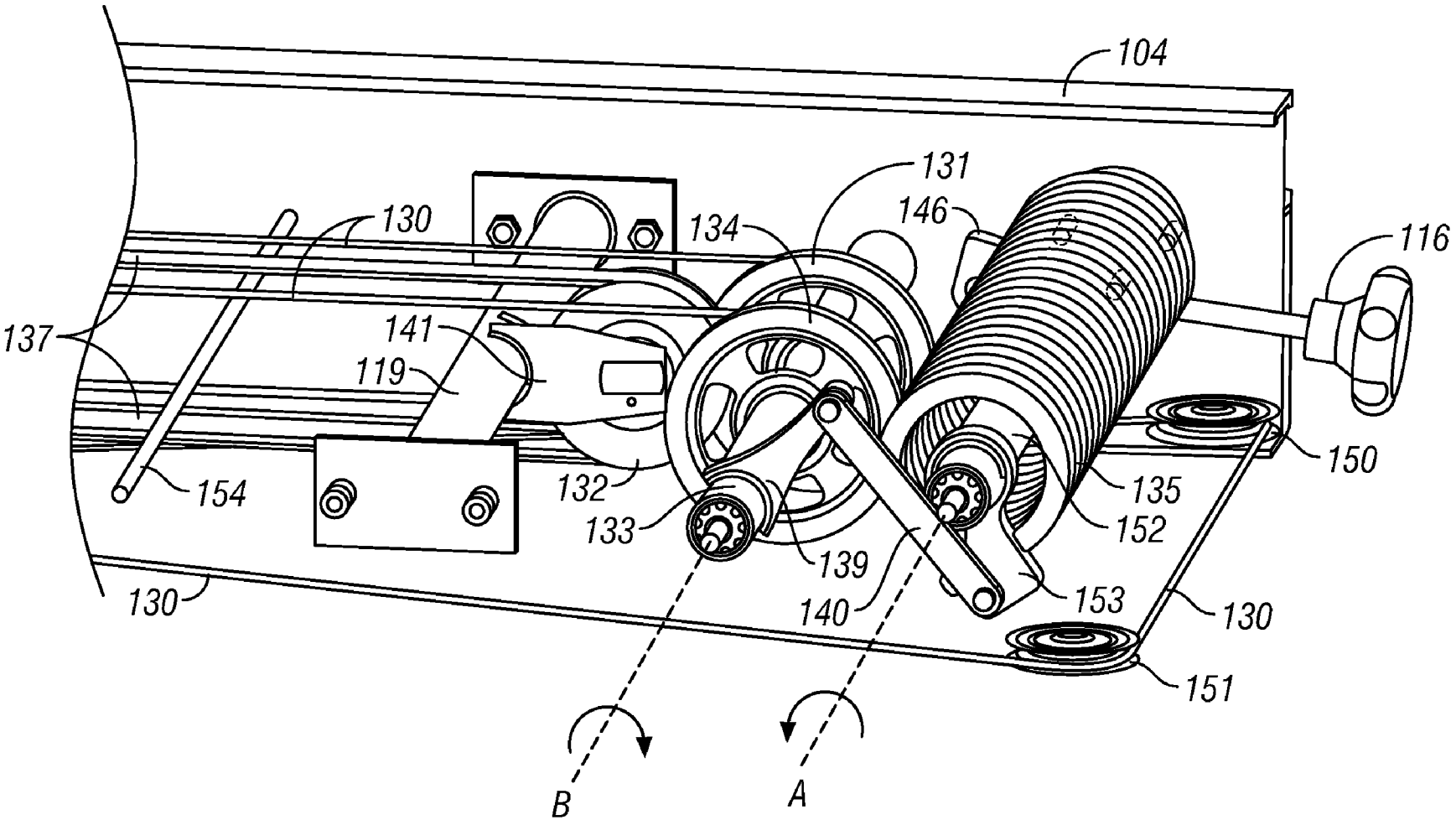
FIG. 9 is another perspective view of a portion of the exercise apparatus of FIG. 1.

Referring now to FIG. 9, as torsion spring 135 is induced to rotate in direction A, attachment 153 affixed to the other end of torsion spring 135 is also induced to rotate in direction A, along with support 152 to which attachment 153 is also affixed. From the position shown in FIG. 9, movement of attachment 153 in direction A causes a force to be transmitted to linkage 139 via coupler 140. Accordingly, linkage 139 is induced to rotate in direction B, causing corresponding rotation of support 133 in the same direction. Notably, rotation of support 133 and support 152 may be facilitated by the use of bearings, for example, to reduce undesired frictional forces.

As support 133 is induced to rotate in direction B, first disk 131 and second disk 134 are each induced to rotate in direction B. Resistance cable 130 is attached at either end to first disk 131 and second disk 134. Hence, as first disk 131 and second disk 134 are induced to rotate in direction B, each end of resistance cable 130 is pulled toward side panel 102, thereby increasing the tension in resistance cable 130 and creating greater resistance to motion of the tension adjustment members. Accordingly, a more strenuous workout may be provided. It will be appreciated that increasing the diameters of first disk 131 and second disk 134 increases the lengths of the moment arms formed by disks 131 and 134 that apply tension to resistance cable 130.

Carriage 105 may be configured to freely roll or slide longitudinally along housing 12. For example, wheels or rollers may be coupled to carriage 105 that allow carriage 105 to roll on top cover 106. Alternatively, third side panel 103 and fourth side panel 104 may include tracks that receive the wheels or rollers of carriage 105.

When used for weight training, the height of horizontal support 110 may be adjusted. As the height of horizontal support 110 is adjusted, there is a corresponding adjustment of the length of pull cable 108 between horizontal support 110 and grip device 107. To allow a user to adjust this length, the portion of pull cable 108 wrapped around spool 155 may be altered. Thus, it should be appreciated that the length of pull cable 108 between pulley 111 and grip device 107 may be altered by altering the portion of pull cable 108 wound around spool 155. In a preferred embodiment, spool 155 is large enough to accommodate a sufficient length of pull cable 108 such that grip device 107 may be retracted to a point at or side panel 101, thereby providing a desirable configuration of exercise apparatus 10 for storage.

Figure 10:
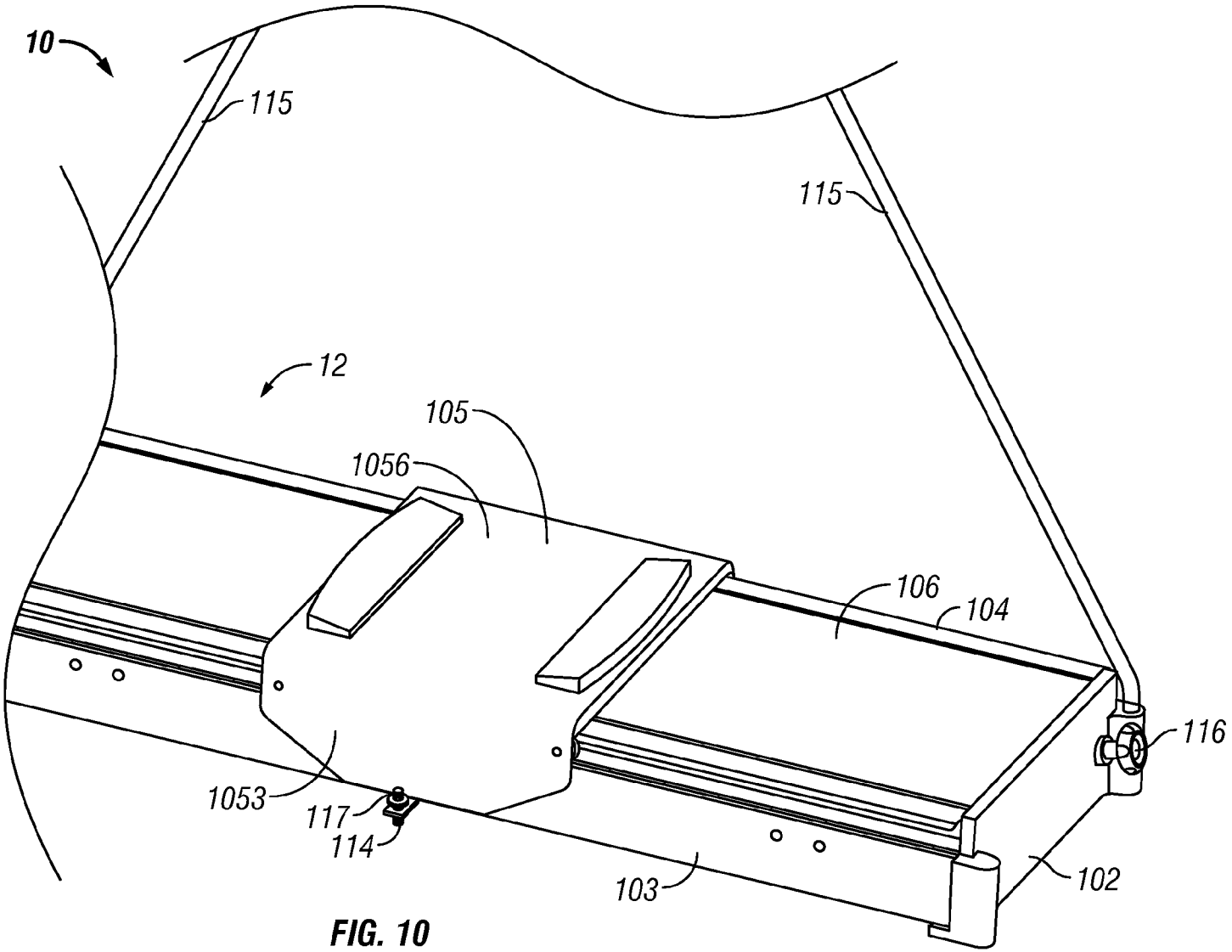
FIG. 10 is a perspective view of another portion of the exercise apparatus of FIG. 1 in the second configuration.
Figure 11:
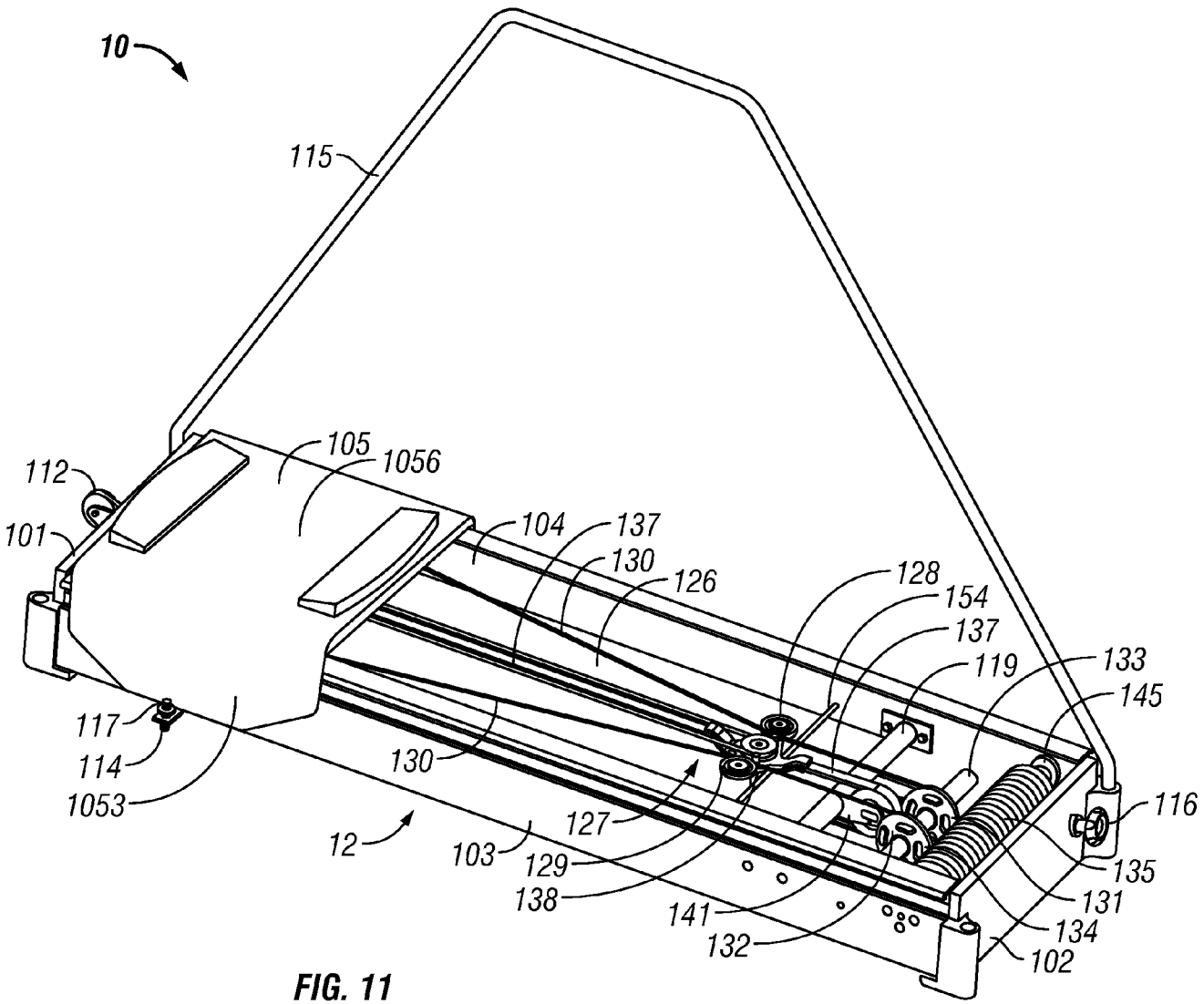
FIG. 11 is a perspective view of another portion of the exercise apparatus of FIG. 1 in the second configuration.

As shown in FIGS. 2, 10 and 11, exercise apparatus 10 may be configured to allow a user to perform exercises that require movement in opposite directions from a neutral intermediate position, such as exercises that simulate down hill skiing. In that configuration, carriage 105 is disposed on cover 106 of housing 12 and may be reciprocated along a path generally parallel to the longitudinal axis of housing 12. Carriage 105 is preferably coupled to attachment 142, another example of a tension adjustment member, so that the resistance assembly may be used to apply resistance against movement of carriage 105 relative to housing 12.

Referring again to FIG. 4, attachment 142 extends beneath side panel 104 and side panel 103. In accordance with one aspect of the claimed invention, two connectors 114 are provided at the ends of attachment 142 that are accessible outside of housing 12. Carriage 105 is coupled to attachment 142 via connectors 114 and attachments 1 17. Because each end of attachment 142 includes connector 114, there is a balancing of the forces that are transferred between carriage 105 and attachment 142, thereby reducing the risk of a significant moment being applied to attachment 142 from carriage 105. In this configuration, attachment 142 is moved when carriage 105 is moved. Attachment 117 may be any suitable device for coupling carriage 105 to connector 114, such as a knob or a pin that passes down through an aperture in carriage 105 and into connector 114.

Pulley 143 and pulley 144 are mounted on attachment 142 between connectors 114. Pulley 143 and pulley 144 are each configured to engage a portion of the second level of resistance cable 130 and to deflect resistance cable 130 to provide the general "X" shape of the second level. In particular, the distance between pulley 143 and pulley 144 is significantly less than the distance between pulley 150 and pulley 151 and the distance between pulley 122 and pulley 149.

Carriage 105 has a lateral dimension slightly wider than the lateral dimension of housing 12 (i.e. the dimension between from side panels 103 to 104) and includes downwardly extending carriage guide surfaces 1053 and 1054, and carriage top surface 1056. Carriage 105 preferably engages side panels 103 and 104 with optional guide rollers or other devices mounted on guide surfaces 1053 and 1054 that reduce friction and help guide carriage 105 along its desired path. Likewise, optional guide rollers or other devices may be mounted beneath top surface 1056 of carriage 105, between carriage 105 and the top cover 106 of housing 12 so as to give balance and enable a smooth travel motion.

Balance support 115 optionally is removably attached at or near either end of side panel 103 or side panel 104. It will be appreciated that balance support 115, as with many other components, may be located in any other suitable position. For example, balance support 115 may be located at or near either end of the rear side panel 103. Likewise, in another embodiment, a balance support is not used, or alternatively the user holds ski poles that can assist with balance.

FIG. 11 depicts exercise apparatus 10 configured for skiing exercises, but is shown with cover 106 removed for clarity, although this component would preferably remain in place during normal use. In this position, carriage 105 is displaced toward side panel 101 and away from the neutral position of attachment 142, which is in the approximate midline between side panel 101 and side panel 102. The location of carriage 105 represents a position in which a user has displaced carriage 105 by the application of force.

As shown in FIG. 11, during use of exercise apparatus 10 for skiing type exercises spindle 138 of mounting assembly 127 remains in contact with member 154 and mounting assembly 127 is not induced to move away from that position during skiing exercises. Instead, attachment 142 reciprocates back and forth with carriage 105 along a path between side panel 101 and side panel 102.

Referring again to FIG. 4, it will be appreciated by one of skill in the art that due to the interaction between resistance cable 130 and attachment 142 and the general "X" shape of the second level of resistance cable 130, attachment 142 is urged toward a central neutral rest position until acted upon by an outside force. That position occurs at a point where the forces acting upon attachment 142 in opposite directions due to tension in resistance cable 130 are equal. Preferably, the neutral rest position is located where the distance from pulley 143 to pulley 149 is the same as the distance from pulley 143 to pulley 150, and the distance from pulley 144 to pulley 122 is the same as the distance from pulley 144 to pulley 151.

As carriage 105 is displaced from this neutral rest position, as when a user is performing skiing exercises, the forces on attachment 142 as applied by resistance cable 130 become unbalanced and apply a restorative force inducing attachment 142 back to the neutral position. As attachment 142 moves further from the neutral position, the restorative force increases. Thus, as a user moves from side to side on carriage 105 a restorative force that varies in intensity acts to oppose the motion of carriage 105, thereby providing resistance for the workout program. Because grip device 107 is not used for skiing, mounting assembly 127 may remain stationary during the skiing exercises.

When configuring exercise apparatus 10 for skiing exercise, a user may adjust the resistance by adjusting knob assembly 116. As described above, adjusting knob assembly 116 alters the preload tension in resistance cable 130, which acts upon attachment 142 to resist movement of attachment 142 along with carriage 105 from the neutral position.

Exercise apparatus 10 may be partially disassembled for convenient storage. In this regard, pull cable 108 may be retracted, as described above. Likewise, vertical supports 109 and horizontal supports 110 are removable and may be stored within the interior space of exercise apparatus 10, along with skiing support 115. When these components are removed and stored, exercise apparatus 10 has a shape resembling a box, and may have a length of approximately 1600 mm, a width of approximately 600 mm, and a height of approximately 180 mm.

It should be appreciated that carriage 105 may be configured to move relative to housing 12 in any desired direction, or stationary, depending upon the exercise desired. Again, when used for rowing or weight training, exercise apparatus 10 is preferably configured such that carriage 105 is uncoupled from connector 114. Therefore, carriage 105 may move freely, whereas attachment 142 remains stationary in the neutral position. It will be appreciated that when exercise apparatus 10 is used for rowing or weight training, forces applied by the user move mounting assembly 127 and attachment 142 remains approximately stationary.

Figure 12:
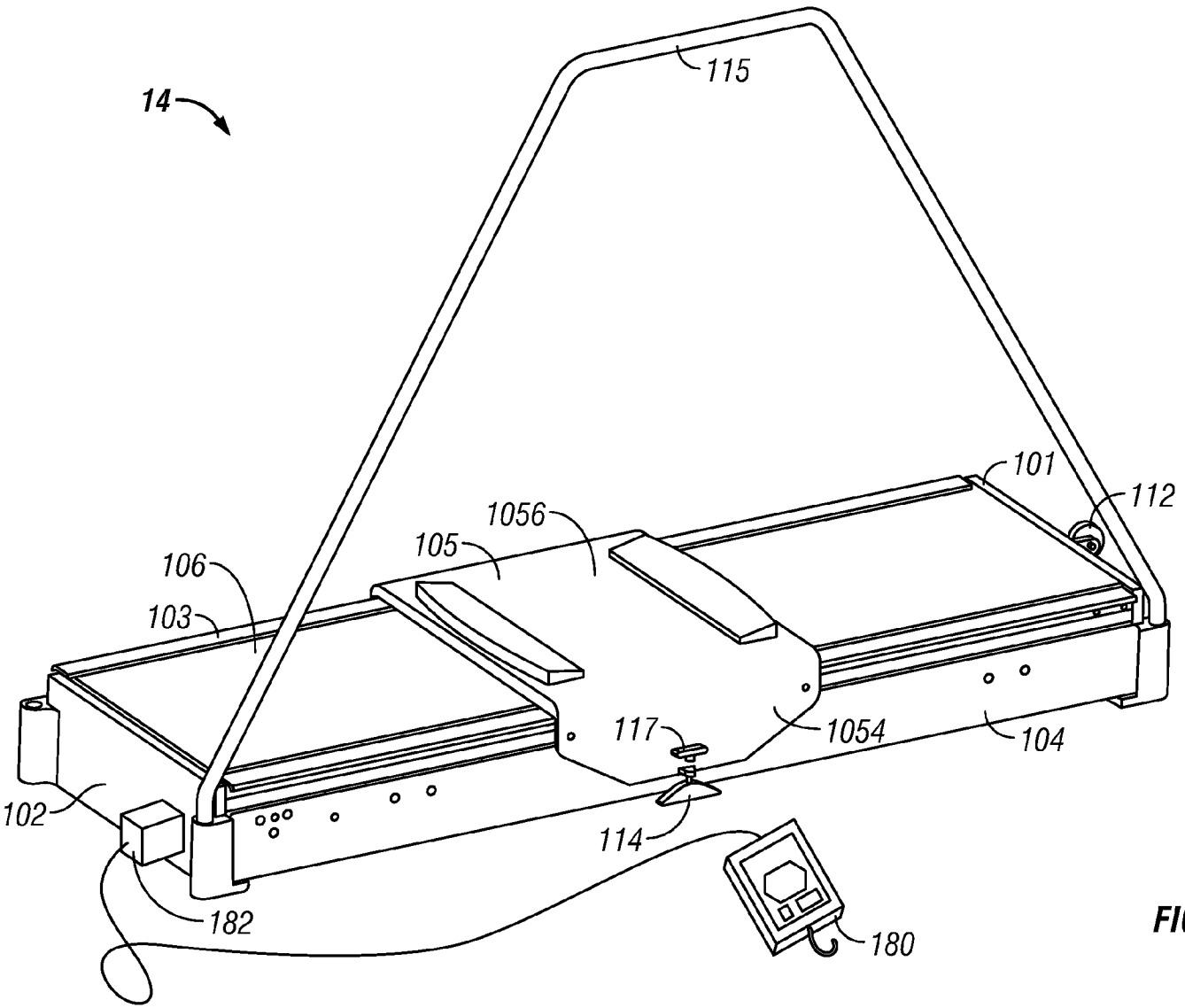
FIG. 12 is a perspective view of another embodiment of an exercise apparatus in accordance with the present invention.

Any of the exercise apparatuses described herein may be modified to include computerized control. For example, FIG. 12 depicts exercise apparatus 14 that has been configured for use as a skiing device. Exercise apparatus 14 includes electronic or digital controller 180 that is in communication with adjusters 182, which may be disposed internally or externally, as shown. Adjusters 182 are used to provide the functionality of previously described knob assemblies 113 and 116. In particular the optional motorized adjusters 182 are used to increase or decrease resistance using similar principles as described above. Hence, a person exercising on exercise apparatus 14 may increase or decrease the resistance of the apparatus through controller 180 and without having to dismount and manually adjust a knob.

One of skill in the art will appreciate that the present invention may be practiced in a variety of embodiments and configurations. For example, exercise apparatus 10 includes a resistance assembly that comprises a tension transmission member, e.g., resistance cable 130, that follows a path having a first level and a second level, as described above. Other embodiments may comprise an exercise apparatus for skiing, rowing, and weight training in which a resistance assembly includes a tension transmission member configured in a single level.

Referring now to FIGS. 13-16, another embodiment of an exercise apparatus 20 in accordance with the present invention is described in which the tension transmission member is configured in a single level. Exercise apparatus 20 may be used for skiing exercises, rowing exercises, and weight training. Exercise apparatus 20 comprises housing 22 that includes first side panel 201, second side panel 202, third side panel 203, fourth side panel 204, first cover 206 and second cover 217. Cover 206 is pivotally mounted to side panel 203 so that housing 22 may be selectively opened and closed by a user.

Supports 260 are disposed in the interior of housing 22 and provide support to cover 206 when it is closed. Supports 260 preferably are coupled to side panels 203 and 204 and provide strength to cover 206 by providing supplemental supporting points. During use weight applied to cover 206 may be supported by supports 260, which transfer force to side panels 203 and 204 and cover 217 of housing 22, which rests on the ground or floor.

Cover 206 may be secured in a closed position by magnets 262, clasps, latches, or other securing mechanisms. These devices act to help prevent inadvertent opening of cover 206 as exercise apparatus 20 is handled. To further facilitate moving the apparatus and/or opening of cover 206, housing 22 comprises one or more openings 264 that may be used as handles.

Housing 22 encloses the resistance assembly provided in exercise apparatus 20. In the present embodiment, the resistance assembly includes tension transmission member, e.g., resistance cable 230, that forms a single level. A user may change the geometry of resistance cable 230 so that it may be configured in a "Y" shaped geometry or an "X" shaped geometry depending on the desired exercise.

A mounting assembly 227, similar to mounting assembly 127 of exercise apparatus 10 described above, interfaces with resistance cable 230 and depending on the configuration of resistance cable 230 will be biased toward a side of housing or to an intermediate neutral position. As shown, mounting assembly 227 is mounted to a belt 237 that forms a closed loop around a pair of pulleys so that mounting assembly 227 may be moved along a reciprocating path.

A first end of resistance cable 230 is affixed to a first eccentric member 231 and is disposed in part along the periphery of eccentric member 231. Resistance cable 230 extends generally parallel to side panel 203 to pulley 247, which is mounted via attachment 258 to support 218.

The path of resistance cable 230 is redirected by pulley 247 toward pulley 228, which is affixed to mounting assembly 227. Resistance cable 230 extends from pulley 228 to pulley 249, which is mounted via attachment 256 to support 219.

Resistance cable 230 is redirected by pulley 249 to pulley 250, which is mounted to support 233. A difference in height of pulleys 249 and 250 relative to cover 217 allows resistance cable 230 to be directed across housing 22 without it interfering with other portions of resistance cable 230. Preferably, pulley 249 is angled from a horizontal plane so that resistance cable 230 is directed generally downward to pulley 250.

Pulley 250 redirects resistance cable 230 across housing 22 to pulley 251, which is also mounted to support 233. It will be appreciated that the path of the remainder of resistance cable 230 is substantially a mirror image of the previously described portion. In particular, from pulley 251, resistance cable 230 extends to pulley 222, which is mounted on support 219 via attachment 257. Resistance cable 230 extends from pulley 222 to pulley 229, which is affixed to mounting assembly 227, and further to pulley 220. Pulley 220 redirects resistance cable 230 to a second eccentric member 234 to which the second end of resistance cable 230 is affixed.

Eccentric member 231 is rotatably coupled to housing 22 via axle 221 that acts as a pivot point. Eccentric member 231 is configured such that the radial distances from axle 221 to locations on the periphery of eccentric member 231 vary along the periphery. Hence, the distance from the pivot point to the location at which resistance cable 230 disengages from eccentric member 231 will vary depending on the amount of rotation of eccentric member 231.

Similarly, eccentric member 234 is rotatably coupled to housing 22 via axle 248 that also acts as a pivot point. Eccentric member 234 is also configured so that the distance from the pivot point to the location at which resistance cable 230 disengages from eccentric member 234 varies depending on the amount of rotation of eccentric member 234.

Each of eccentric members 231 and 234 is coupled to a torsion spring 235 so that rotation of the eccentric member causes rotational displacement of an end of the torsion spring relative to the other end of the respective torsion spring. In the present embodiment, each eccentric member is coupled to torsion spring 235 via linkage 239 and coupler 240.

Torsion springs 235 are configured to exert a force through linkages 239 and couplers 240 on a respective eccentric member. Accordingly, couplers 240 apply force to eccentric members 231 and 234, causing eccentric members 231 and 234 to experience a moment about their respective axles.

It will be appreciated by one of skill in the art that the use of eccentric members 231 and 234 may result in a non-linear relationship between the resistance force applied to mounting assembly 227 by the resistance assembly and the movement of mounting assembly 227. In this regard, the deflection of a simple spring is linearly related to the force that is applied to the spring. In the configuration described here and in FIGS. 13-16, the use of couplers 240, linkages 239 and eccentric members 231 and 234 results in a non-linear relationship between the force and the deflection, which may provide more desirable exercise conditions for a person using exercise apparatus 20.

As described briefly above, the geometry of the single leveled resistance cable 230 may be changed between a "Y" shaped geometry and an "X" shaped geometry. That capability is provided by movably mounting pulleys 220 and 247 on support 218 and by movably mounting pulleys 222 and 249 on support 219. In particular, attachments 258 and 259, which support pulleys 247 and 220, respectively, are coupled to support 218 so that the positions of attachments 258 and 259 on support 218 are adjustable. In the present embodiment, attachments 258 and 259 are threaded on support 218 so that rotation of support 218 causes attachments 258 and 259 to move in opposite directions along support 218.

Similarly, attachments 256 and 257, which support pulleys 249 and 222 respectively, are coupled to support 219 so that the position of those attachments on support 219 may also be adjusted. In particular, attachments 256 and 257 are threaded on support 219 so that rotation of support 219 causes attachments 256 and 257 to move in opposite directions along support 219.

Adjusters 213 and 216 are provided to manipulate the positions of the pulleys. Adjuster 213 is coupled to support 219 so that rotation of adjuster 213 alters the positions of pulleys 222 and 249 along support 219. Adjuster 216 is coupled to support 218 so that rotation of adjuster 216 alters the positions of pulleys 220 and 247 along support 218. Preferably, adjusters 213 and 216 are accessible outside of housing 22 so that the pulleys may be manipulated without being required to access the interior of housing 22. Position indicators may be included on adjustors 213, 216 and/or side panel 203 to indicate the positions of the pulleys along the supports or to indicate whether resistance cable 230 is in a "Y" or "X" configuration.

It should be appreciated that one pair of the pulleys may be adjustable while the second pair of pulleys is fixed, if desired. Preferably, in such a configuration the fixed pulleys are spaced so that one is adjacent opposite corners of housing 22. In such a configuration the adjustability of the one pair of pulleys allows the resistance cable to be configured in a single "Y" configuration and a single "X" configuration.

When using exercise apparatus 20 for rowing or weight training, the pulleys are adjusted so that resistance cable 230 is in a "Y" configuration. During use, a user may pull on a grip device (not shown) that is attached to one end of pull cable 208. Pull cable 208 extends through side panel 201 and is looped around pulley 236 affixed to mounting assembly 227. Pull cable 208 then extends back through side panel 201 out of housing 22 and the other end is affixed to a spool 255 located on the exterior of exercise apparatus 20. Openings are provided in side panel 201 to allow for the passage of pull cable 208. Excess length of pull cable 208 may be taken up by coiling that the pull cable around spool 255, which preferably is mounted on side panel 201 near the openings.

Similar to the previously described embodiments, mounting assembly 227 is mounted on belt 237, which is looped around pulleys 224 and 232. A portion of the path of rotation of belt 237 defines the path of mounting assembly 227.

When a user pulls on the grip device, a tensile force is exerted by the user on pull cable 208, which causes mounting assembly 227 to move toward side panel 201. As the force exerted by the user is decreased, mounting assembly 227 returns along the same path under the influence of the preload tension in resistance cable 230 exerted by torsion springs 235.

Upright support 209, which supports pulley 211, may be removably engaged with mounts on horizontal support 210 when exercise apparatus 20 is used for rowing or weight training exercises. Pull cable 208 may then extend from pulley 212 to pulley 211 so that grip device may be used at different heights. Horizontal support 210 may be used to secure pulley 212 around which pull cable 208 passes.

A user may adjust the position of horizontal support 210 of exercise apparatus 20 relative to housing 22 to a desired position. Horizontal support 210 is attached to side panel 201, via attachment members 253, so that its distance from side panel 201 may be easily adjusted. For example holes in side panel 201 may be configured to receive attachment members 253 and sleeves 254 may be included that include a central lumen that also receives an attachment member 253. Sleeves 254 may be configured to reduce the size of the lumen such that as the sleeves are tightened in side panel 201 the center lumens reduce around the attachment members 253. Accordingly, when attachment members 253 are placed within the lumens of the sleeves, and the sleeves are tightened into side panel 201, attachment members 253 and horizontal support 210 are secured in place. In another embodiment, attachment members 253 comprise threaded rods that are configured to thread into threaded sleeves coupled to side panel 201.

Horizontal support 210 further comprises mounts 274. Mounts 274 are horizontally offset from one another a predetermined distance selected such as to accommodate upright support 209. Accordingly, when exercise apparatus 20 is used for some weight training or resistance exercises, upright support 209 may be mounted in mounts 274, and pull cable 208 may be passed around pulley 212 and then around pulley 211 which is mounted on upright support 209. In some embodiments, upright support may have additional adjustable features allowing the height of pulley 211 to be selected within a predetermined range.

When exercise apparatus 20 is used as a rowing device, additional features of the rowing configuration include the use of carriage 205 as a free rolling seat on housing 22. Additionally, horizontal support 210 may be used as a foot support.

Figure 13:
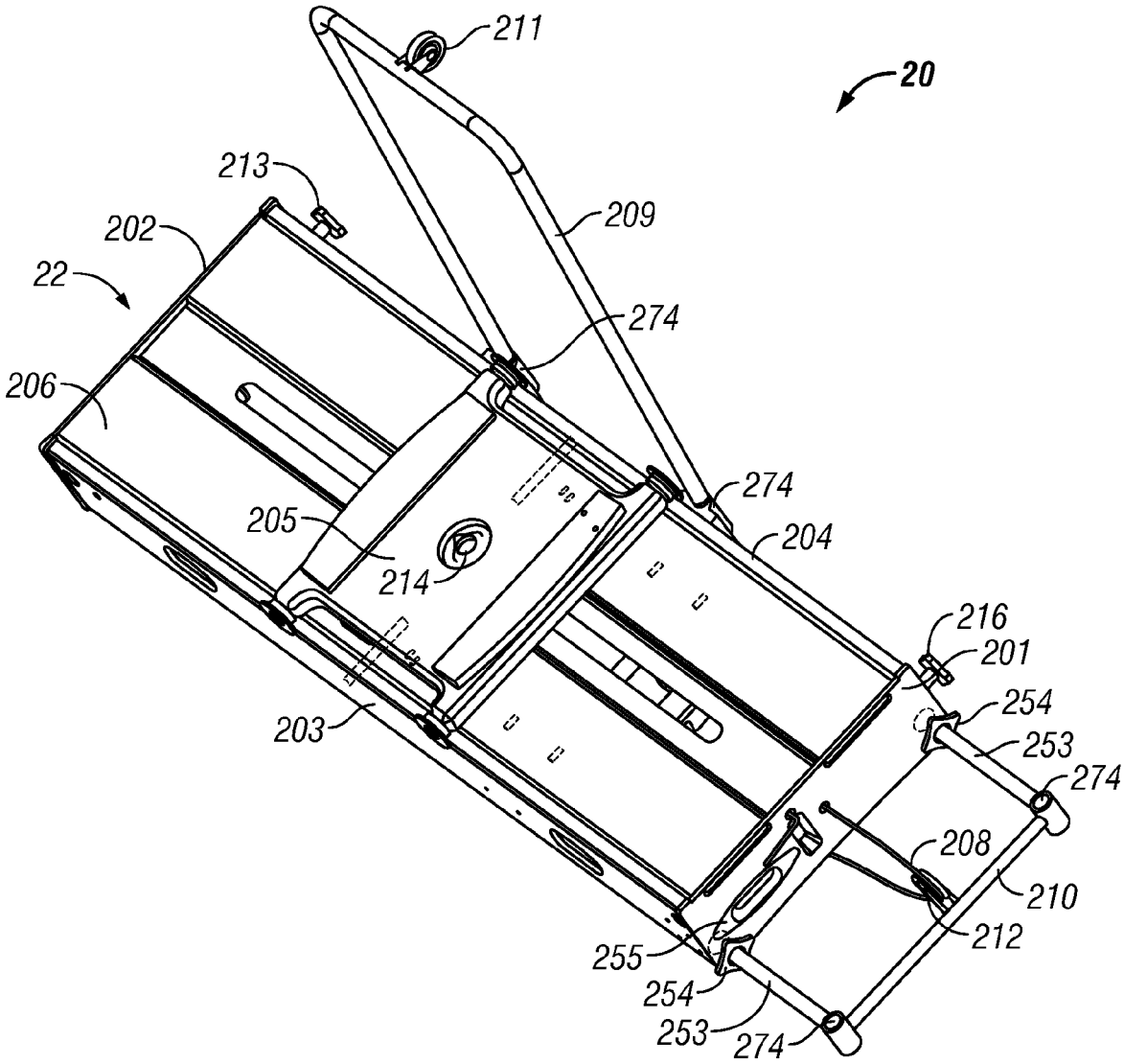
FIG. 13 is a perspective view of another embodiment of an exercise apparatus in accordance with the present invention.
Figure 14:
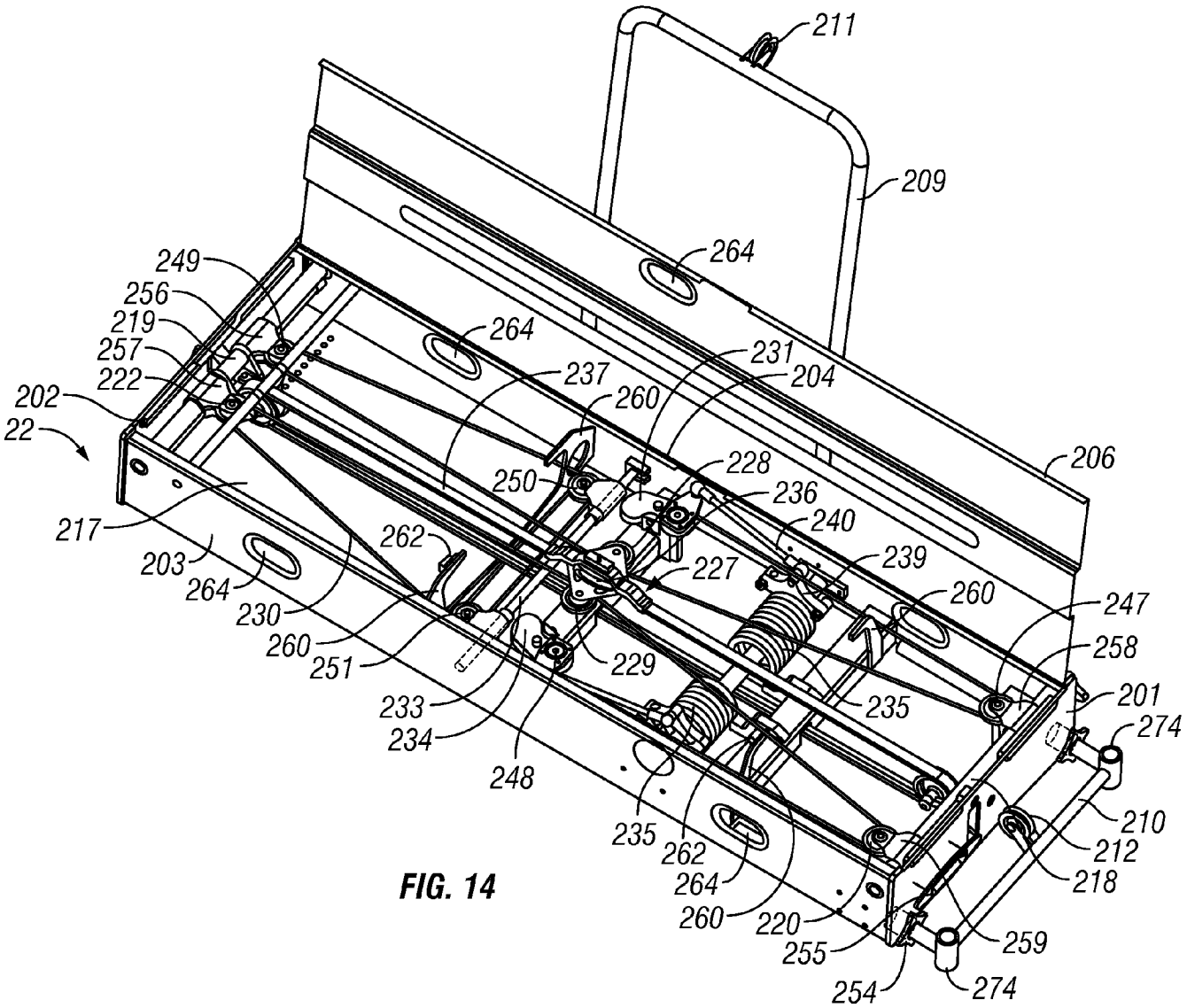
FIG. 14 is another perspective view of the exercise apparatus of FIG. 13.
Figure 15:
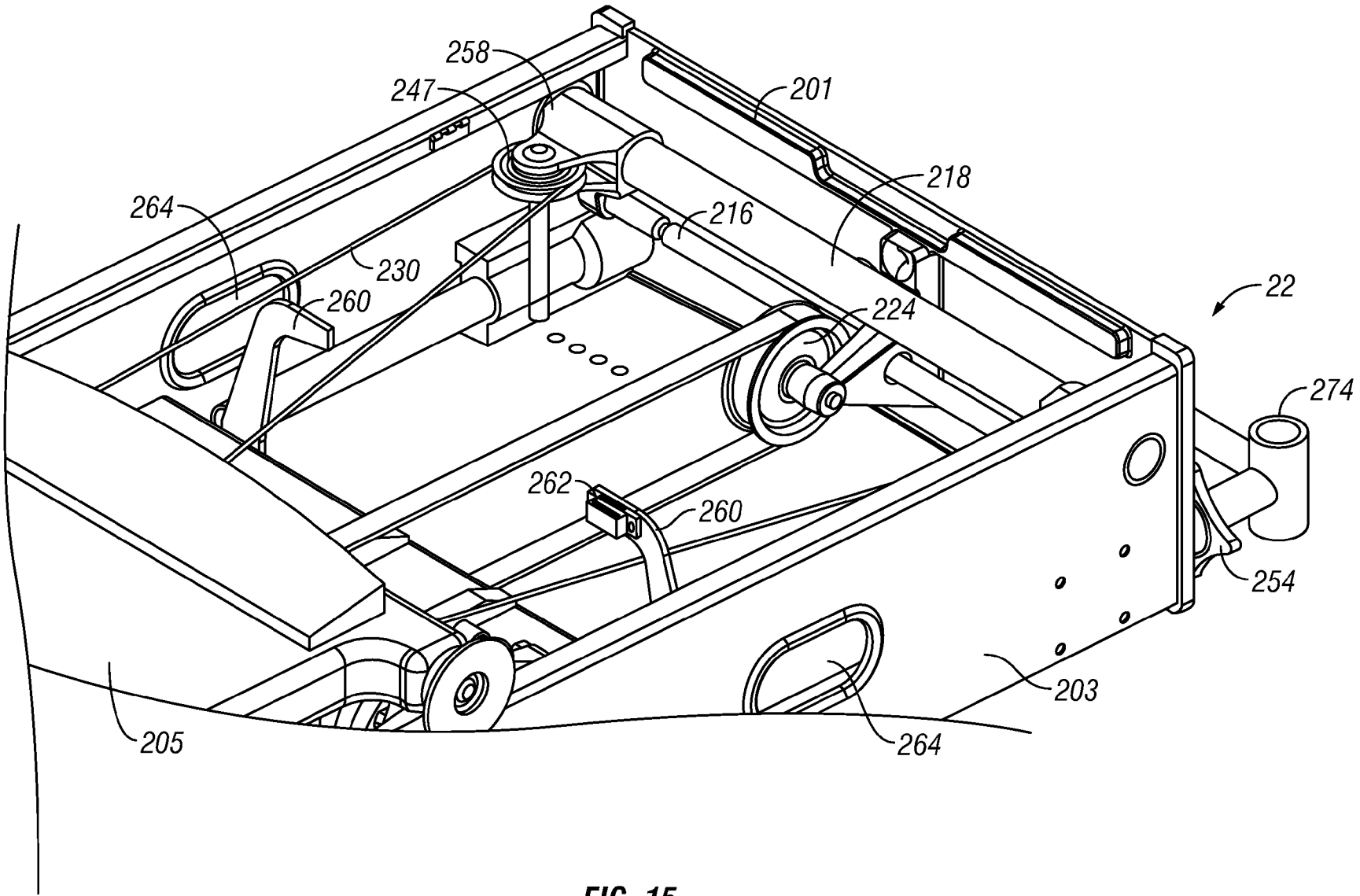
FIG. 15 is a perspective view of a portion of the exercise apparatus of FIG. 13.
Figure 16:
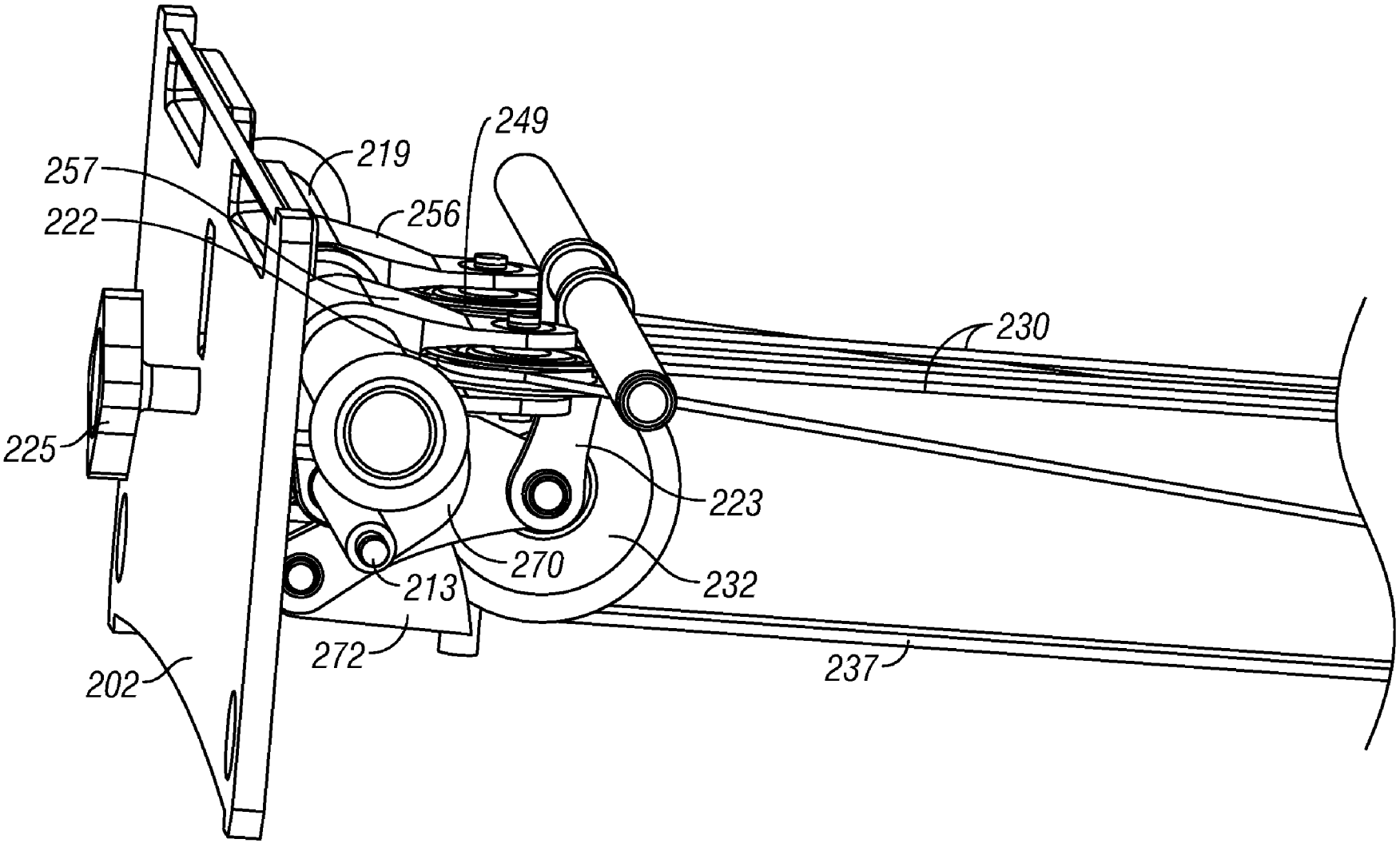
FIG. 16 is a perspective view of another portion of the exercise apparatus of FIG. 13.

In order to configure exercise apparatus 20 for skiing exercises, as shown in FIG. 13, the system is configured so that mounting assembly 227 has a neutral, stable, position that is preferably located at or near the midpoint of the reciprocating path of mounting assembly 227. This may be achieved by adjusting the positions of the pulleys so that resistance cable 230 is in an "X" configuration. In the "X" configuration the forces acting on mounting assembly 227 by resistance cable 230 are balanced when at rest, and mounting assembly 227 is in an intermediate neutral position. Upright support 209 also may be coupled to side panel 203 so that a user may grasp upright support 209 for stability during exercise.

In addition, carriage 205, which is configured to move along a path atop cover 206 is coupled to mounting assembly 227 via connector 214 so that resistance assembly provides resistance to movement of carriage 205. Connector 214 may be a pin, screw, or other component that couples carriage 205 to mounting assembly 227. Preferably mounting assembly 227 is enclosed within housing 22. As a result, connector 214 may be configured to extend through a slot included in cover 206, as shown, or as will be described below in greater detail, mounting assembly 227 may include a portion that extends laterally outward of housing 22 so that carriage 205 may be attached.

During use, a user forces carriage 205 along a reciprocating path. Because carriage 205 is coupled to mounting assembly 227, mounting assembly 227 is also moved along the path of carriage 205 and interaction between mounting assembly 227 and resistance cable 230 resists that movement. Furthermore, because the pulleys are adjusted so that resistance cable is in an "X" configuration, mounting assembly 227 is biased to the neutral position that is approximately located at the center of the housing. As a result, movement of carriage 205 from that neutral position toward either side panel 201 or side panel 202 is resisted by resistance cable 230 of the resistance assembly.

The forces applied by resistance cable 230 that act to return mounting assembly 227 to the neutral position increase with an increased displacement of mounting assembly 227 from the neural position. In such a manner, a user experiences resistance to side-to-side motion of carriage 205, thereby providing the skiing exercise mechanism.

As shown in FIG. 13, carriage 205 interfaces with mounting assembly 227 through a slot in cover 206. However, in another embodiment, carriage 205 may be coupled to mounting assembly 227 via an attachment that extends laterally outward from mounting assembly 227, similar to attachment 142 of the previously described embodiment. As a result, the slot through cover 206 is not required which reduces the likelihood of foreign objects entering the interior of housing 22. In such an embodiment, side panels 203 and 204 may be raised off of the floor to allow an attachment to extend laterally outward below the side panels from mounting assembly 227. Alternatively, side panels 203 and 204 may include slots extending along their length, which allow portions of an attachment to extend out of housing from mounting assembly 227 above the floor. In an embodiment where it is desired to have an attachment extending laterally outward from housing 22 close to the ground, the resistance assembly may be inverted so that mounting assembly 227 is disposed near the floor.

Carriage 205 may comprise wheels to facilitate movement along housing 22. As described above, carriage 205 is used when exercise apparatus 20 is configured for skiing exercises and is coupled to mounting assembly 227. However, it should be appreciated that carriage 205 may be utilized in a free rolling configuration, as well during any desired exercise. Carriage 205 may be free rolling when there is no attachment between carriage 205 and mounting assembly 227. Carriage 205 may include cushions, pads, or other support as desired.

When using exercise apparatus 20 for rowing exercises, the system may be configured such that mounting assembly 227 has a resting position that preferably is located at or near the end of its reciprocating path nearest side panel 202. For example, adjuster 213 may be manipulated such that attachments 256 and 257 are moved relatively close to one another. In a preferred embodiment, the distance between attachments 256 and 257 is selected so that the distance between pulleys 222 and 249 is approximately the same as the distance between pulleys 228 and 229 on mounting assembly 227. Adjuster 216 also is manipulated such that attachments 258 and 259 are moved apart from one another. In this configuration, pulleys 220 and 247 are positioned near the corners of the interior space of housing 22, whereas pulleys 222 and 249 are near the midline.

Accordingly, resistance cable 230 is configured to resemble a "Y" or a "V" when mounting assembly 227 is adjacent side panel 202, when viewed with cover 206 in the open position. In that configuration, the forces acting on mounting assembly 227 by resistance cable 230 induce that component toward side panel 202 and help maintain mounting assembly 227 at the end of its reciprocating path.

Mounting assembly 227 moves toward side panel 201 when a user applies forces to mounting assembly 227, for example by a user pulling pull cable 208 via a grip device. When this occurs, the tension in resistance cable 230 increases, thereby increasing the restorative force applied by torsion springs 235 that induces mounting assembly 227 toward the rest position, i.e., toward side panel 202 in a rowing configuration or toward the neutral position in a skiing configuration. The forces applied by resistance cable 230 that act to return mounting assembly 227 to its starting position increase with an increased displacement of mounting assembly 227. In such a manner, a user may experience resistance to motion as that user continues to pull on pull cable 208, thereby providing the rowing exercise mechanism.

It will be appreciated by one of skill in the art that the forces applied by resistance cable 230 that act to return mounting assembly 227 to the starting position may be varied by varying the distance between pulleys 222 and 249 and the distance between pulleys 220 and 247. The further pulleys are from one another, the greater the restorative force will be for a given displacement of mounting assembly 227. Conversely, the closer each of a pair of pulleys is to the other, the lesser the restorative force will be for a given displacement. Preferably, the location of the pulleys in each pulley pair is symmetric with regard to the centerline of housing 22 to provide balanced force to pulleys 228 and 229.

When used for weight training or similar resistance exercises, the pulleys are arranged in a similar manner as for rowing exercises. Hence, the pulley configuration that is appropriate for the rowing exercises is also appropriate for weight training exercises. The main differences between the configurations of exercise apparatus 20 when used for weight training in comparison to that for rowing are the removal of carriage 205 and the addition of upright support 209. Unlike rowing exercises, when it may be desirable to use carriage 205 as a freely rolling seat, it may me desirable to either sit or stand on a fixed surface when using exercise apparatus 20 for weight training. Thus, carriage 205 may be selectively removed from housing 22 for weight training. Likewise, upright support 209 may be attached to mounts 274 to allow pull cable 208 to pass over pulley 211 at an elevated height. In this fashion, a user may position pull cable 208 at an elevation, thereby providing increased versatility in weight training exercises.

In an embodiment, a user may select the configuration of exercise apparatus 20 by inverting exercise apparatus 20 so that either cover 206 or cover 217 forms the top surface of housing 22. For example, exercise apparatus 20 may be configured with cover 206 atop housing 22 when using the exercise apparatus 20 for skiing exercises and oriented with cover 217 atop housing 22 when using the device for rowing exercises or weight training. Such a feature may be utilized in embodiments utilizing a unidirectional clutch as discussed in greater detail below. In the latter orientation, a user may pull on a grip device 207 attached at one end of a tension transmission member, such as pull cable 208, against resistance provided by the internal resistance assembly during an exercise routine.

Optionally, pulley 232, which supports belt 237, may be configured to restrict motion in a given rotational direction. This restriction may be provided using a unidirectional clutch, such as clutch 270 and clutch brake 272, shown in FIG. 16. When clutch 270 is engaged with pulley 232, pulley 232 may rotate in one direction, but rotation is restricted or prevented in the opposite direction. When clutch 270 is disengaged from pulley 232, pulley 232 may rotate freely in both directions.

Clutch 270 is selectively engaged and disengaged via clutch brake 272, responsive to the orientation of exercise apparatus 20, i.e., whether housing 22 is oriented with cover 206 or cover 217 as a top surface. When exercise apparatus 20 is configured for skiing exercises, clutch brake 272 may be induced in one direction due to the downward force applied by gravity, and is configured to disengage clutch 270. Hence, pulley 232 may rotate freely and allow mounting assembly 227 (and therefore carriage 205) to move side to side with no appreciable resistance from clutch 270.

Conversely, when exercise apparatus 20 is configured for rowing or weight training exercises, it may be inverted from the skiing configuration. In such an orientation, clutch brake 272 is induced in a second direction due to the downward force applied by gravity, and is configured to engage clutch 270. Hence, pulley 232 may rotate freely in only one direction, allowing mounting assembly 227 to move freely in one direction but not the other. As a result, belt 237 is required to slide over pulley 232 in one direction thereby providing additional resistance to one direction of motion of mounting assembly 227. Thus, the system may be configured to resist motion of mounting assembly 227 in response to a tensile force applied by a person via resistance cable 230, but allows mounting assembly to freely return to a previous position once that tensile force is lessened.

Additionally, pulley 232 may be mounted on a pendulum 223 so that the position of pulley may be adjusted. In the present embodiment, knob assembly 225 is provided which alters the position of pulley 232. Adjusting the position of pulley 232 alters the tension in belt 237, which alters the magnitude of resistance applied by the resistance assembly to movement of mounting assembly 227. Therefore, turning knob assembly 225 alters the resistance to movement of mounting assembly 227.

When the exercise apparatus 20 is stored and not in use, upright support 209 may be removed and placed in the interior of the exercise apparatus or into the interior of a concealment housing as discussed below. To facilitate access to the interior space, cover 206 may pivot open using hinges. When cover 206 is closed and exercise apparatus 20 is configured for storage, the system may fit under furniture. In other embodiments, exercise apparatus may be integrated with furniture, a wall, or another household item or structure as described below.

Another embodiment, exercise apparatus 30, is shown in FIGS. 17-25. Exercise apparatus 30 comprises housing 32 that is constructed from first side panel 301, second side panel 302, third side panel 303, fourth side panel 304 and cover 306. Similar to the previously described embodiments, housing 32 defines an internal space that houses a resistance assembly that provides resistance to a user during exercise. In the present embodiment, the resistance assembly and housing generally have the same configuration as that of exercise apparatus 10 described above. Furthermore, exercise apparatus 30 may be configured for skiing exercises, rowing exercises, and weight training.

Figure 17:
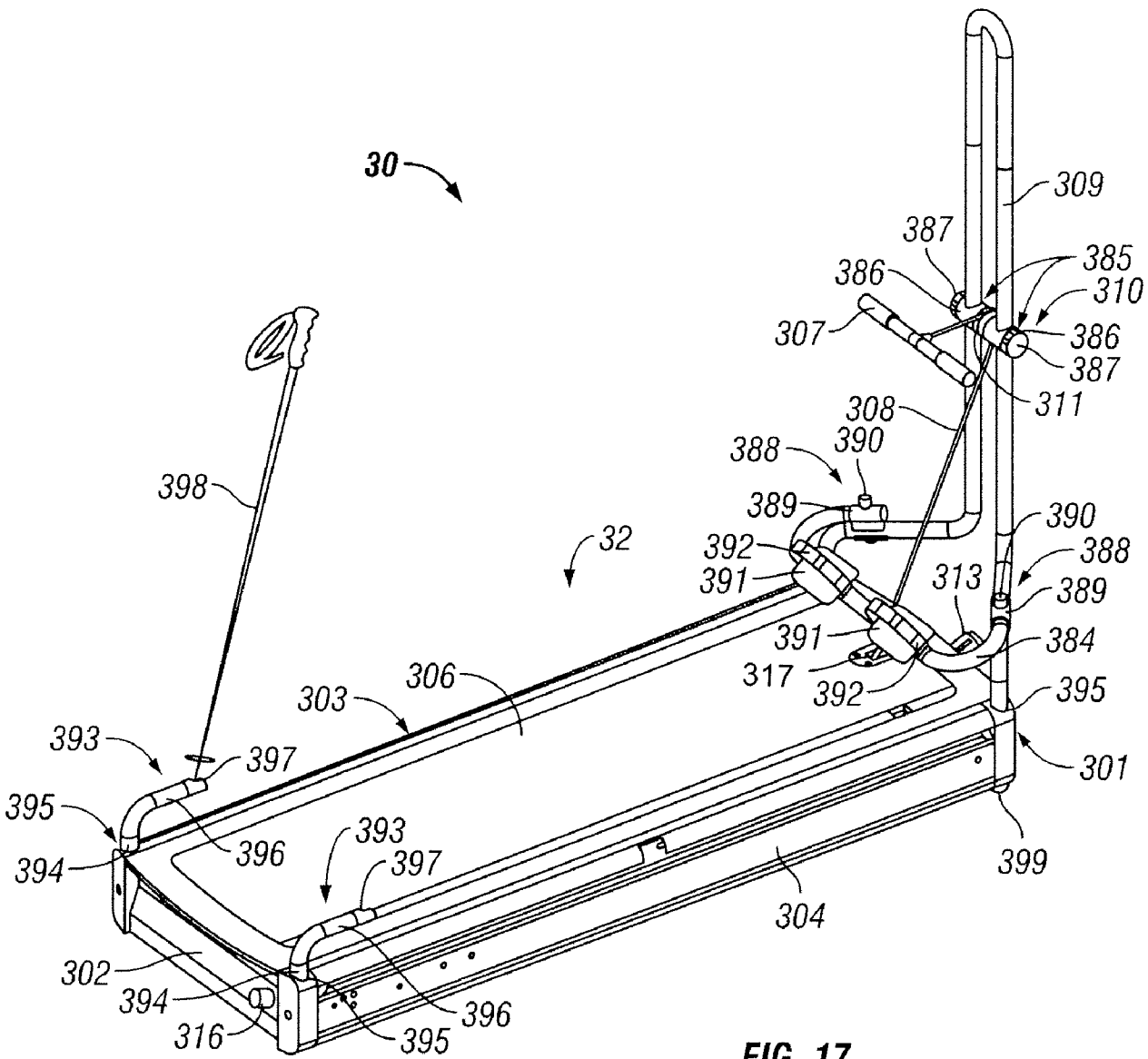
FIG. 17 is a perspective view of another embodiment of an exercise apparatus in accordance with the present invention.
Figure 18:
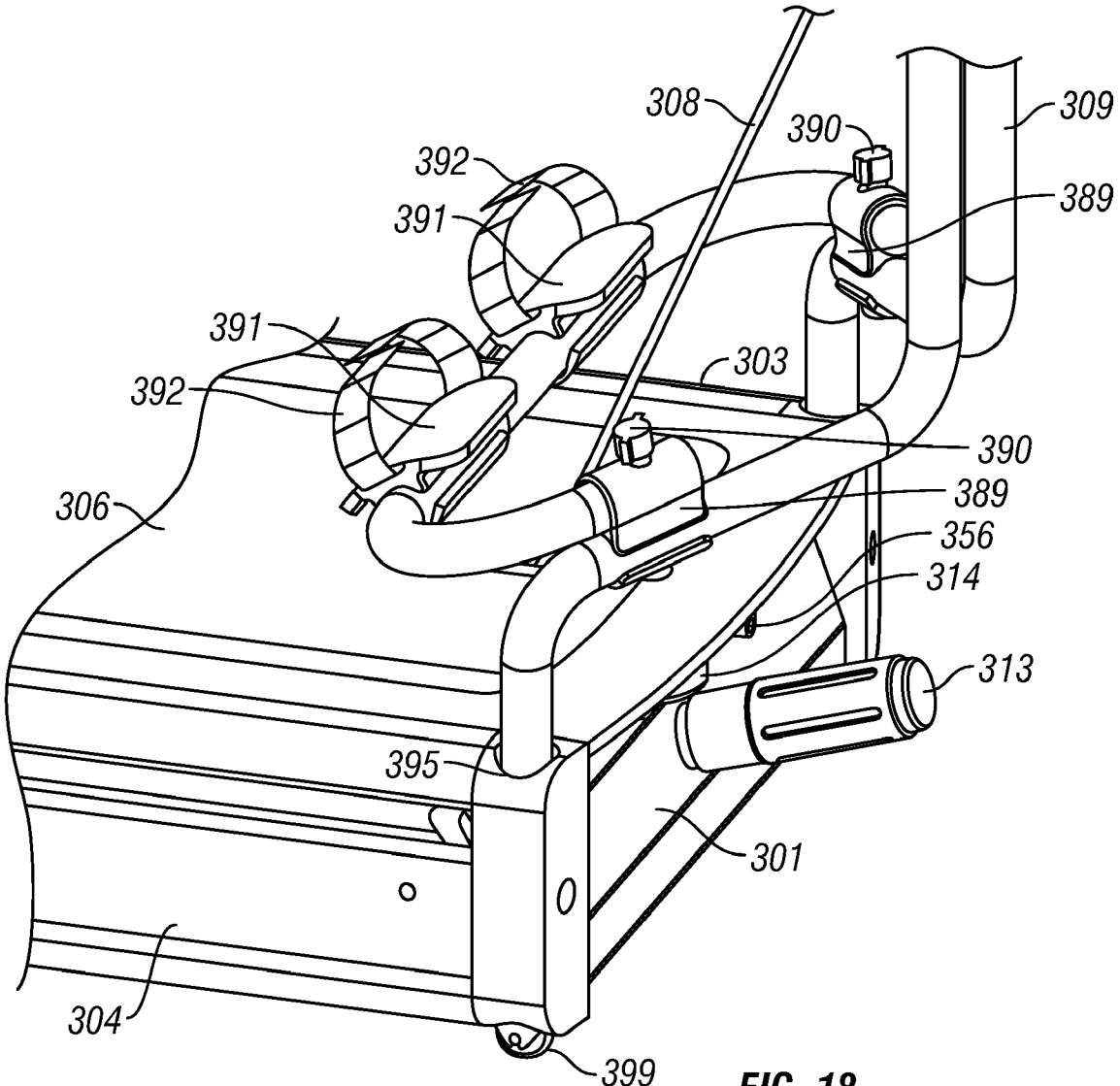
FIG. 18 is a perspective view of a portion of the exercise apparatus of FIG. 17.
Figure 19:
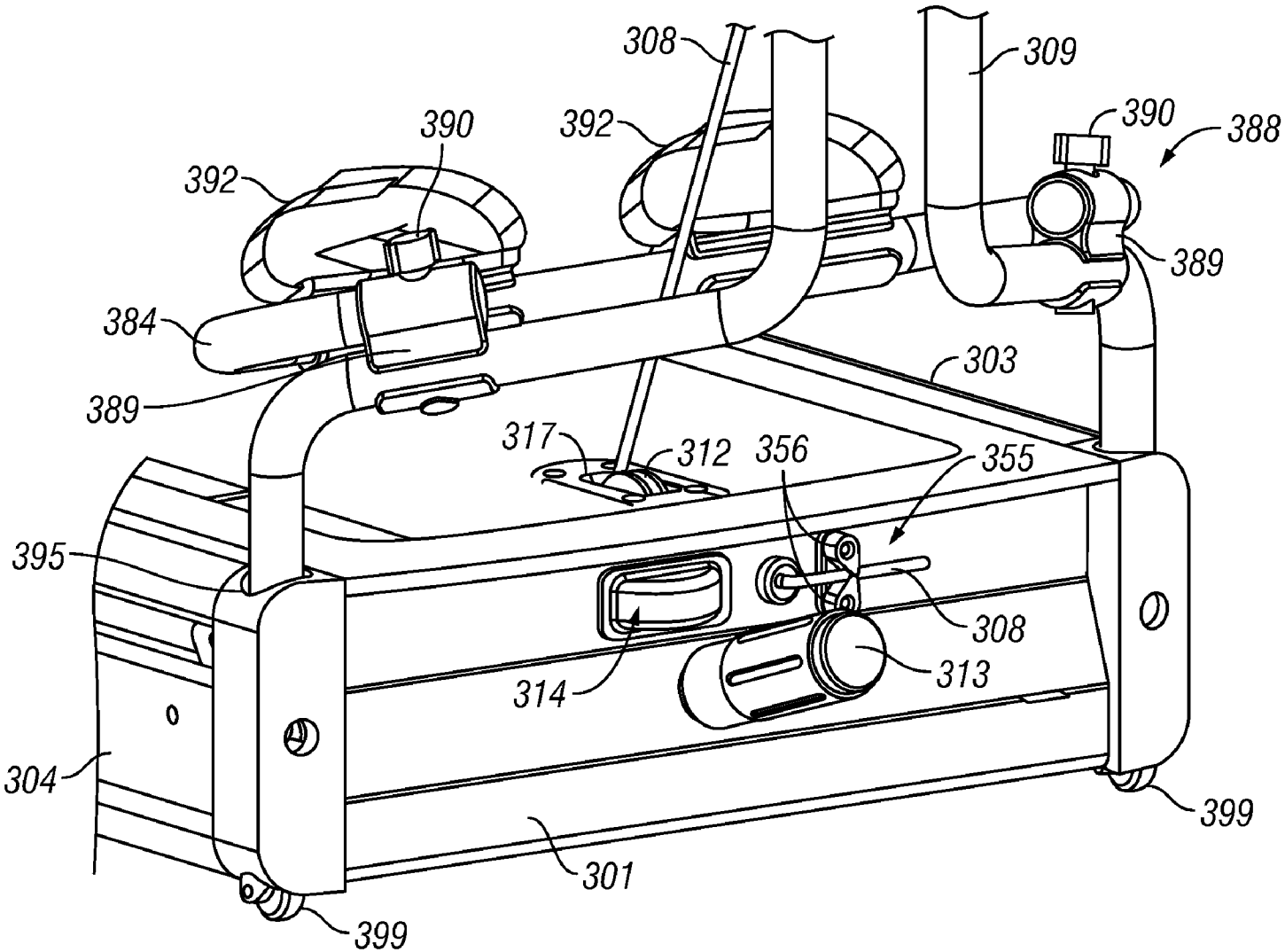
FIG. 19 is a perspective view of another portion of the exercise apparatus of FIG. 17.

As shown in FIG. 17, exercise apparatus is configured for weight training exercises. In that configuration, a carriage configured to translate along the longitudinal axis of housing 32 has been removed so that a user may stand on cover 306 and exercise by pulling grip device 307 which is coupled to the resistance assembly through pull cable 308.

Figure 20:
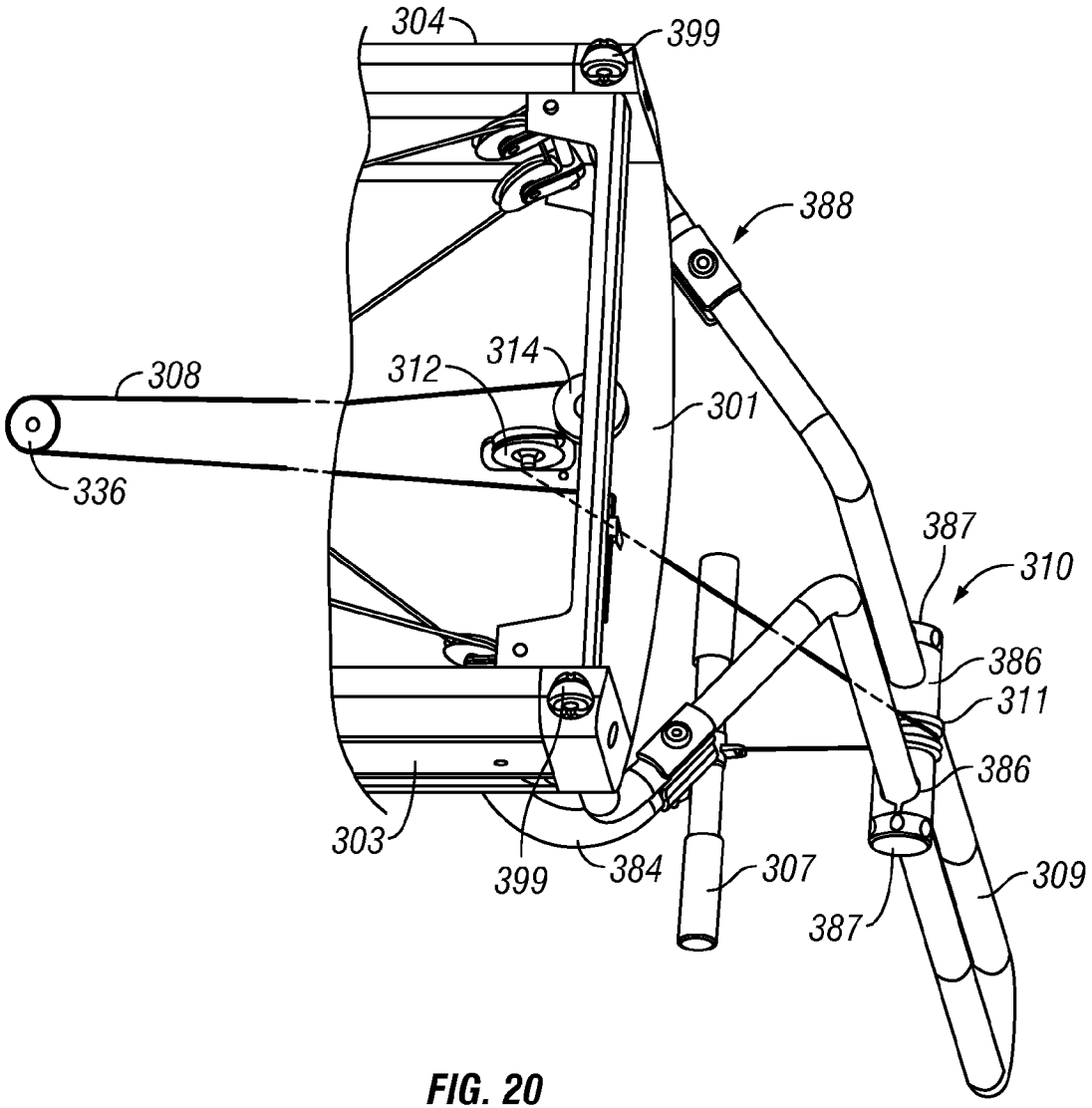
FIG. 20 is a bottom perspective view of a portion of the exercise apparatus of FIG. 17.
Figure 21:
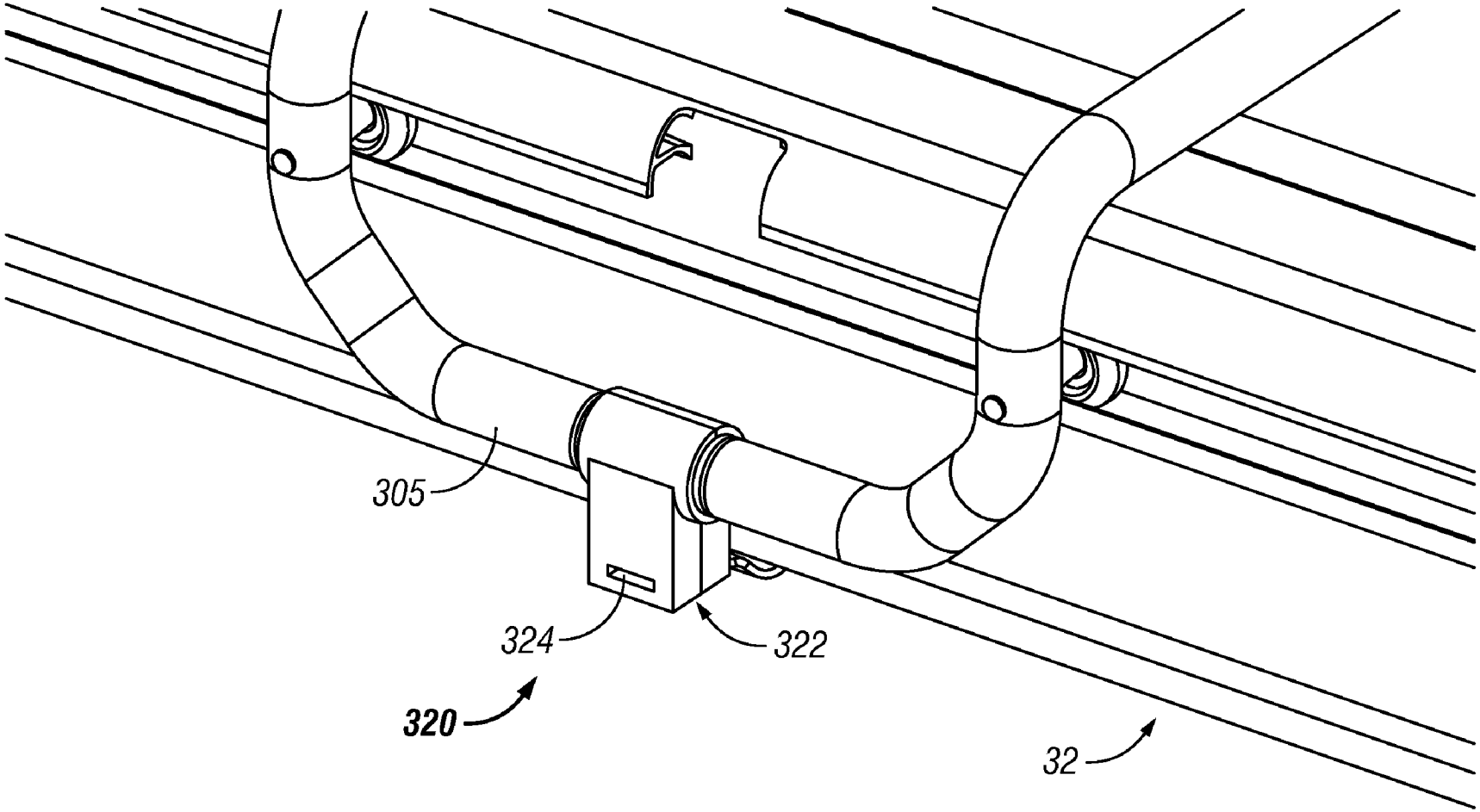
FIG. 21 is a perspective view of a portion of an exercise apparatus including a coupling in a locked position.
Figure 22:
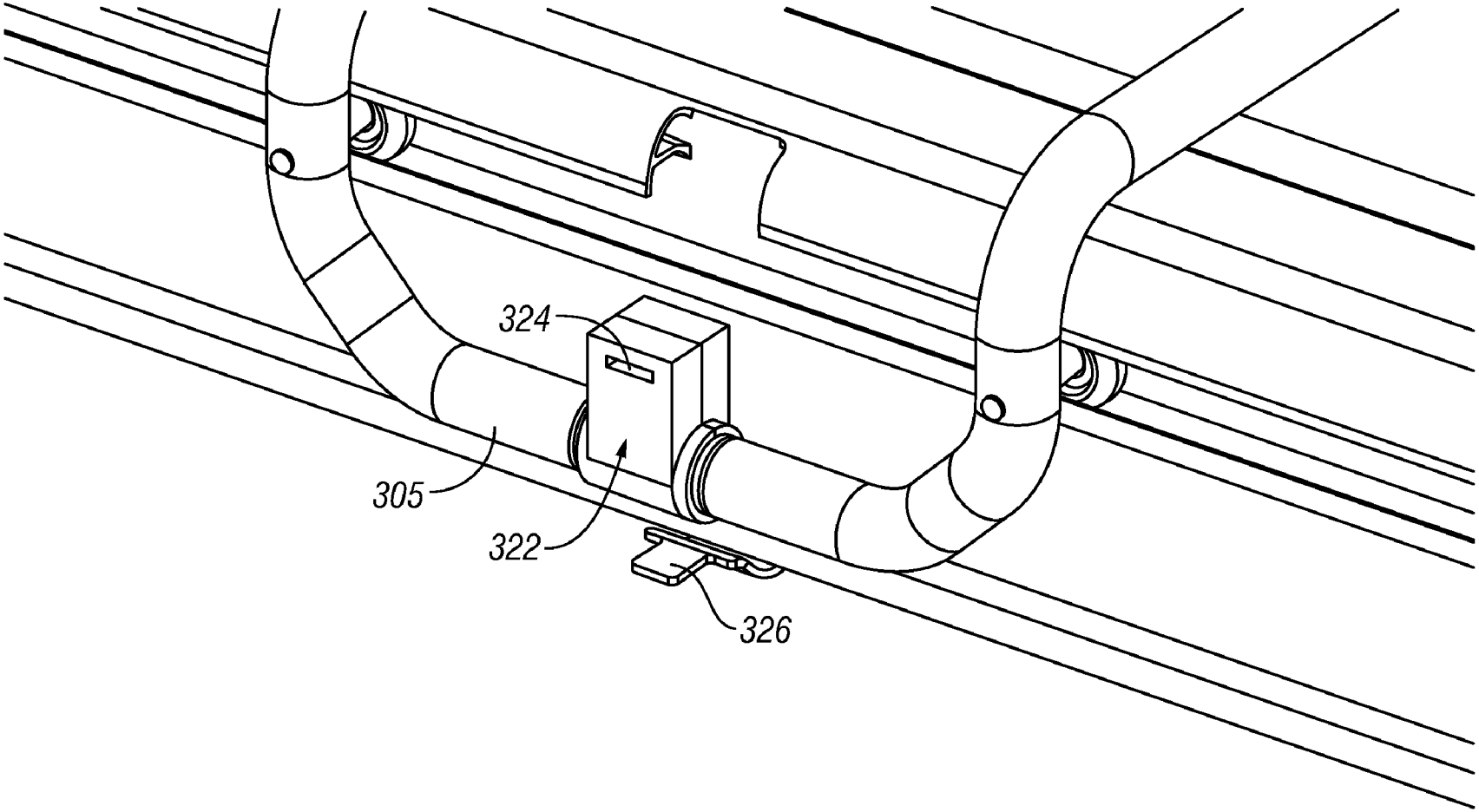
FIG. 22 is a perspective view of a portion of an exercise apparatus including a coupling in an unlocked position.

In the present embodiment, the resistance assembly is a two level assembly that has a construction generally identical to exercise apparatus 10 described above, but the geometry of pull cable 308 has been modified to reduce the overall size of exercise apparatus 30, as shown in FIG. 20. In particular, pull cable 308 extends from grip device 307 to pulley 311 that is supported by horizontal support 3 10. Pulley 311 redirects pull cable toward pulley 312, which is located in the interior of housing 32. Pull cable 308 extends through an aperture 317 included in cover 306 and engages pulley 312. Pulley 312 redirects pull cable 308 to pulley 314 that is mounted in housing 32 adjacent side panel 301. Pulley 314 redirects pull cable 308 toward pulley 336 that is included on a mounting assembly (not shown) included in the resistance assembly. Pulley 336 of the mounting assembly redirects pull cable 308 toward side panel 301 where pull cable 308 exits housing 32.

The free end of pull cable 308, i.e., the end of pull cable opposite the attachment with grip device 307, that extends out of housing 32 is selectively fixed by fixing clamp 355 rather than a spool as previously described. Fixing clamp 355 includes a pair of rotating cams 356 that are configured to rotate about parallel axes of rotation, which in the present embodiment are normal to the outer surface of side panel 301. Cams 356 are preferably biased to rotate in opposite directions and may include engagement features on an outer surface that are configured to increase friction between the outer surface and pull cable 308.

Fixing clamp 355 is configured to prevent the free end of pull cable 308 from being pulled toward the interior of housing 32. For example, in the present embodiment, as a user applies force to grip device 307, the tension in pull cable 308 increases. That increased tension has a tendency to draw the free end of pull cable 308 toward the interior of housing 32. Friction between pull cable 308 and cams 356 causes cams 356 to rotate as pull cable 308 translates. Additionally, cams 356 are configured so that as pull cable 308 translates toward the interior of housing 32 and cams 356 rotate, the distance between cams 356 reduces which pinches the portion of pull cable 308 therebetween. As cams 356 pinch pull cable 308, they restrict the translation of pull cable 308, thereby preventing the free end of pull cable 308 from being pulled into the interior of housing 32.

Exercise apparatus 30 also includes mechanisms that allow the user to adjust the magnitude of resistance applied by the resistance assembly to movement of a movable carriage or grip device 307. In particular, knob assembly 313 is included that allows the user to adjust the resistance applied by resistance assembly to movement of grip device 307. Additionally, knob assembly 316 is included that allows the user to adjust the resistance applied to either a movable carriage or grip device 307. Operation of knob assemblies 313 and 316 is similar to the operation of the same devices included in exercise apparatus 10.

Upright support 309 is coupled to housing 32 adjacent side panel 301. Upright support 309 includes an upper portion that supports horizontal support 310 and a lower portion that supports a foot support 384. Horizontal support 310 extends horizontally across the upper portion of upright support 309 and includes integrated pulley 311. Pulley 311 is supported by horizontal support so that it rotates about the longitudinal axis of horizontal support 310.

Horizontal support also includes clamp members 385 that include a clamping body 386 and a release member 387. In the present embodiment, each clamping body 386 extends around a portion of upright support 309. Release member 387 is a turn knob that is coupled to clamping body 386 and configured so that turning release member 387 selectively causes clamping body 386 to apply a clamping force on upright support 309, thereby retaining horizontal support 310 in place. It should be appreciated that any clamping device may be utilized, such as pins, quick-release cam devices, screws, etc.

Foot support 384 is a generally C-shaped member that is coupled at each end to the lower portion of upright support 309. Clamp members 388 are used to selectively couple foot support 384 to upright support 309. Each clamp member 388 includes clamping body 389 and release member 390. In the present embodiment, clamping body 389 includes a tubular portion that receives an end of foot support 384 and release member 390 is a bolt that extends through the tubular portion, the end of foot support and an aperture in upright support 309. Clamping body 389 also includes an arcuate surface that receives a portion of upright support and a clamping saddle that mates with release member 390. As release member 390 is tightened, a portion of upright support 309 is clamped between the arcuate surface of clamping body 389 and the clamping saddle. It should be appreciated, however, that any clamping mechanism known in the art may be used.

A pair of foot rests 391 are mounted to foot support 384 and provide a surface for the user to comfortably rest their feet. Foot rests 391 may also include foot straps 392 so that a user may strap their feet in position upon foot rests 391, for example, during rowing exercises. Foot rests 391 are coupled to foot support 384 so that their location on foot support 384 may be altered to adjust to the comfort of a user.

Exercise apparatus 30 may also be configured for exercises simulating skiing. As described above, a support member may coupled to housing to provide a gripping surface for a user during skiing exercises, for example as shown in FIG. 11. Exercise apparatus 30 includes ski pole supports 393 that are coupled to housing 32 and provide a feature for receiving a portion of a user's ski poles so that a user may use actual ski equipment rather than a support member.

As shown in FIG. 17, pole supports 393 are positioned at the corners of housing 32 adjacent side panel 302, which generally corresponds to a storage configuration. In order to use exercise apparatus 30 for skiing exercises, a translating carriage is mounted on housing 32 and coupled to the resistance assembly and one of pole supports 393 is moved to a corner of housing adjacent side panel 301 so that both pole supports 393 are located at corners of housing 32 adjacent either side panel 303 or side panel 304.

Pole supports 393 are generally L-shaped members that include a mounting portion 394 that extends into an aperture 395 included at a corner of housing 32 and a ski pole receiving portion 396. Ski pole receiving portion 396 includes aperture 397 that is configured to receive a tip of a users ski pole 398. Aperture 397 is sized so that ski pole 398 is able to tilt when it is attached to support 393.

In the skiing configuration, a moving carriage 305 is preferably coupled to a tension adjustment member, such as a mounting assembly, via a coupling. Referring to FIGS. 21-25 an exemplary coupling 320 will be described. Coupling 320 generally includes housing 322 that is rotatably coupled to a portion of carriage 305. Housing 322 may be selectively rotated between a locked position, shown in FIG. 21, and an unlocked position, shown in FIG. 22.

Housing 322 includes an aperture 324 that is configured to receive lock tab 326 included on the mounting assembly that extends laterally from housing 32. The length of aperture 324 in the direction of travel of carriage 305 is selected to so that there is minimal clearance between the edges of aperture 324 and lock tab 326 when coupling 320 is locked so that relative motion between lock tab 326 and housing 322 is minimized during use.

Figure 23:
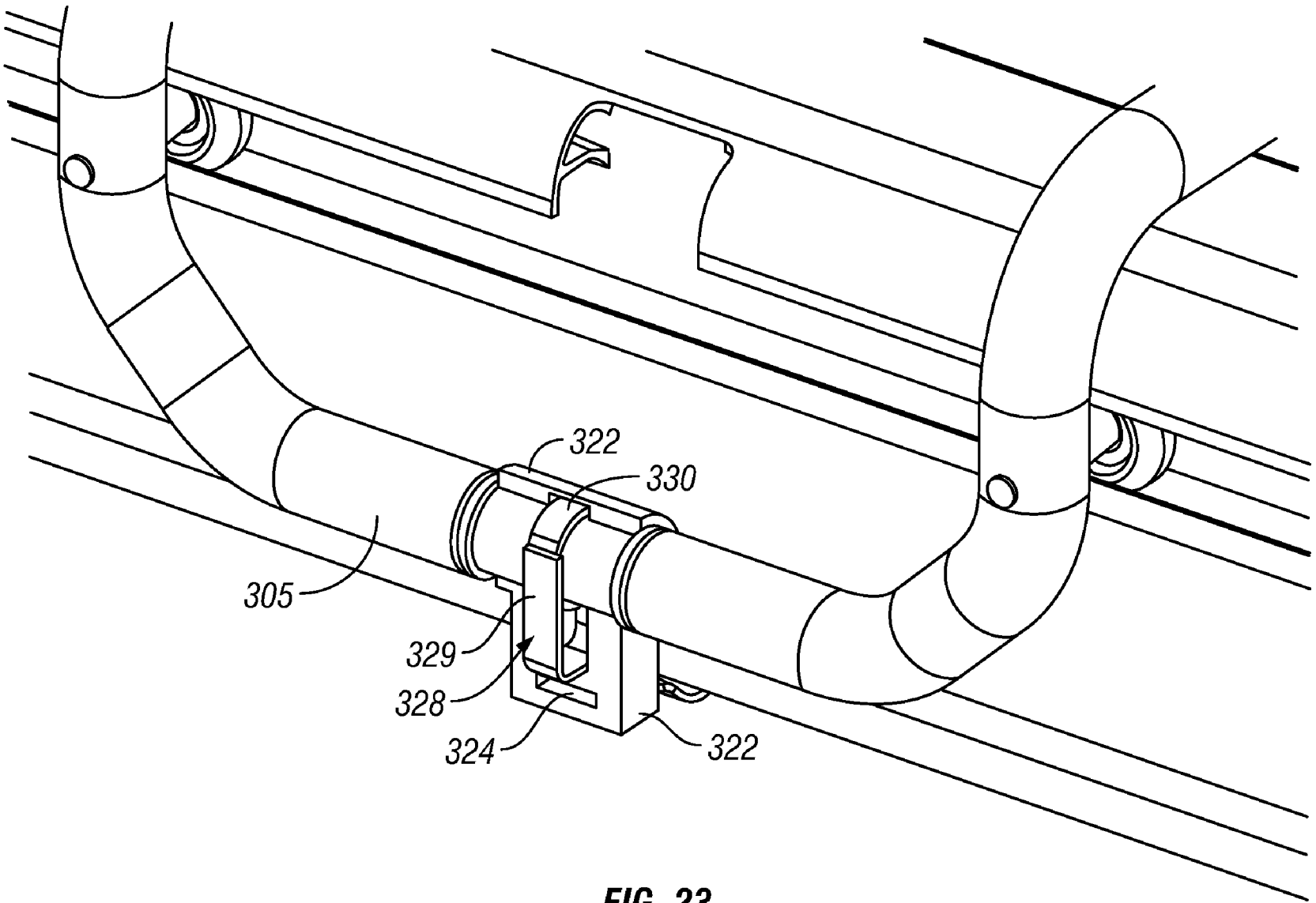
FIG. 23 is another perspective view of the portion of the exercise apparatus of FIG. 21.
Figure 24:
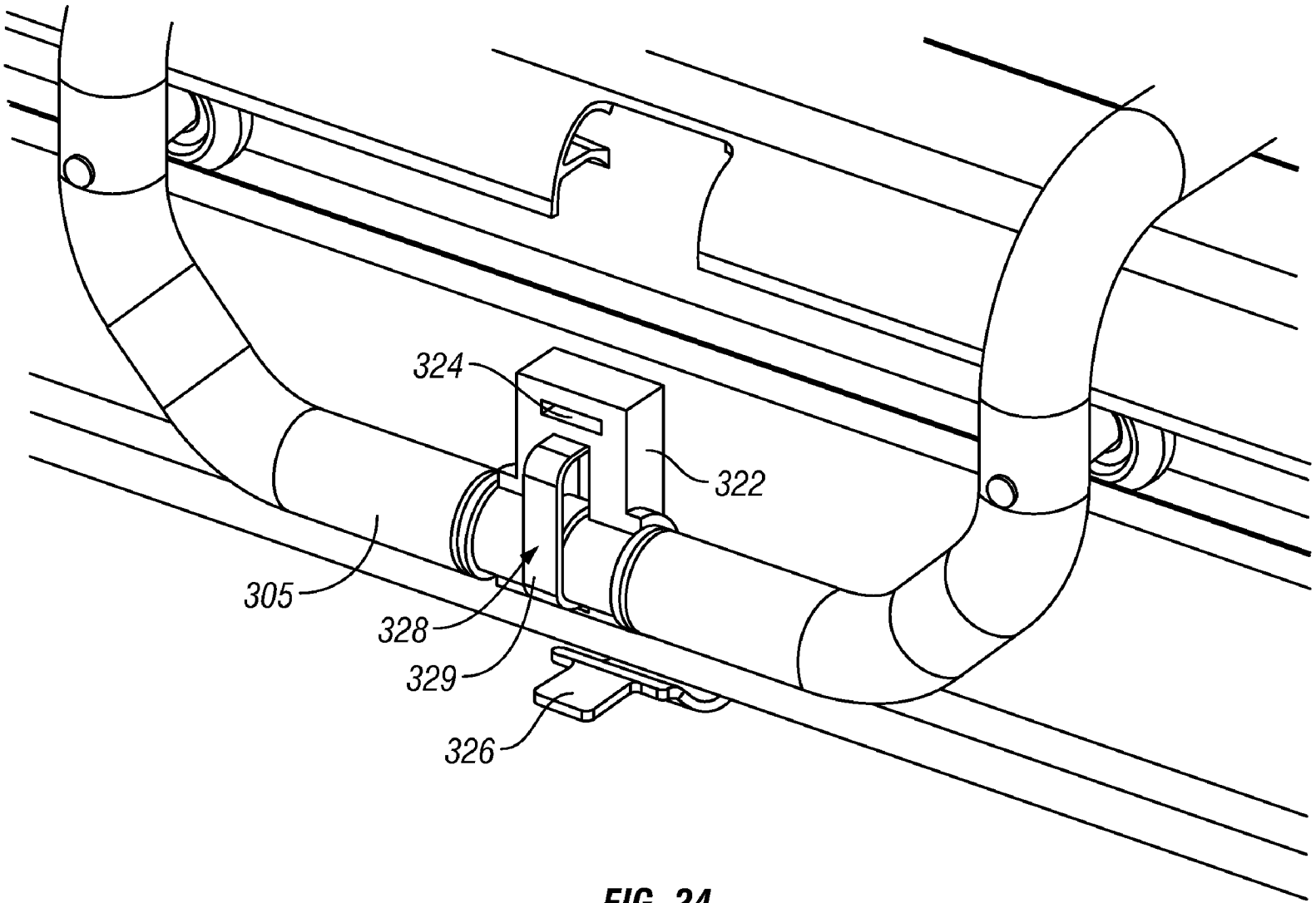
FIG. 24 is another perspective view of the portion of the exercise apparatus of FIG. 22.
Figure 25:
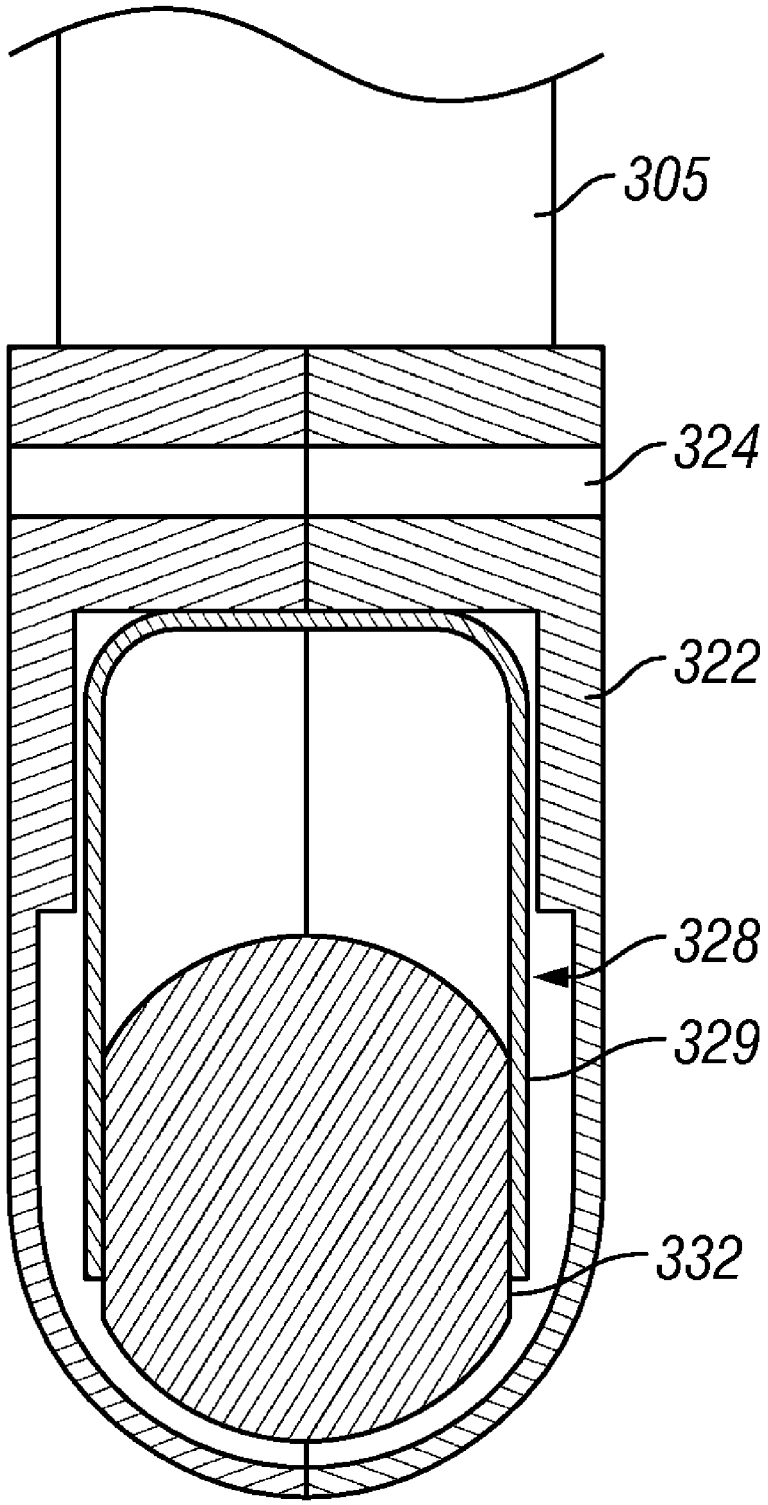
FIG. 25 is a cross-sectional view of the coupling of FIG. 22.
Figure 26:
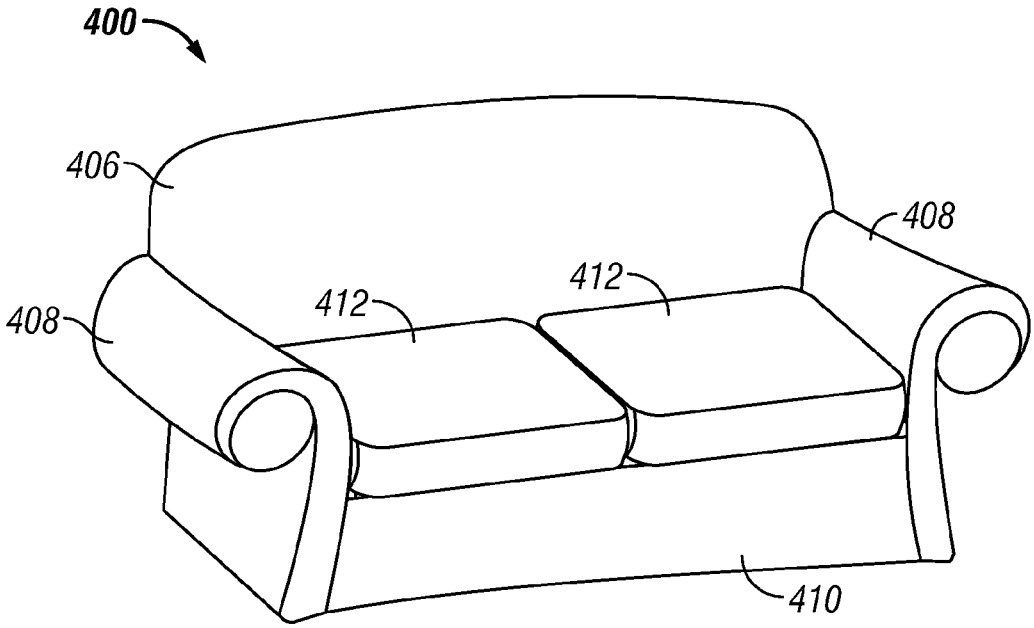
FIG. 26 is a perspective view of an embodiment of an integrated exercise system in which an exercise apparatus is integrated into a sofa in a closed configuration in accordance with the present invention.

Referring to FIGS. 23-25, housing 322 is retained in either the locked or unlocked position by spring 328 and lock collar 330. Spring 328 includes two arms 329 and is generally U-shaped. Spring 328 is oriented within housing 322 so that arms 329 apply radial forces diametrically upon an outer surface of collar 330.

Collar 330 includes a pair of facets 332 located diametrically from each other. Facets 332 are generally flat surfaces that interface with arms 329 of spring 328 to provide detente positions of housing 322. The distance between the surfaces of facets 332 generally corresponds to the dimension between arms 329 of spring 328 when spring 328 is in a nondeflected state. In addition, the diameter of the remainder of collar 330 is greater than the distance between facets 332 so that when spring is in any position other than the locked or unlocked positions arms 329 are deflected.

Housing 322 is held in either the locked or unlocked position by the interface between spring 328 and facet 332. When a user desires to rotate housing 322 from one of those detente positions, additional torsional force must be applied because arms 329 of spring 328 must be deflected to rotate away from facets 332.

Additionally, exercise apparatus 30 includes wheels 399 that may be used to roll the apparatus to a desired location. Wheels 399 assist a user in positioning the apparatus as desired. It should be appreciated that any rollers, wheels or low friction members may be attached to ease movement of the apparatus.

Still other embodiments of the exercise apparatus may omit the use of a torsion spring and instead use one or more tension transmission members comprising an elastic member. In these latter embodiments, increased resistance is provided as the tension transmission member is stretched from a more relaxed position to a more taut position due to force inputted from the user through the tension adjustment member.

Additionally, it should be appreciated that the movable carriages of the above-described embodiments may be formed of multiple components that are coupled to form a complete carriage. In such embodiments, the tension adjustment members that are attached to the carriages may also be formed by separate components that are coupled to form a complete tension adjustment member. As a result, when the components are separate, a first portion of the carriage may be coupled to a first portion of the tension adjustment member and a second portion of the carriage may be coupled to a second portion of the tension adjustment member. The user may then move a portion of the carriage independently of the other. As each portion of the tension adjustment member moves along a predetermined path it causes the geometry of the tension transmission member to change which results in the resistance assembly applying resistance to the movement of the portion of the tension adjustment member. Such an embodiment would be especially well suited for a user to perform an exercise that simulates cross-country skiing.

As a further alternative, the portions of carriage may be coupled to a pair of pull cables that are each attached to a portion of the tension adjustment member. In such an embodiment, as one portion of the carriage is moved from an initial position the interaction between the tension adjustment member and the tension transmission member induce the portion of the carriage back to the initial position.

It should also be appreciated that any of the exercise apparatus described above may be supplied with manual or motorized leg levelers so that the angle of the housing relative to the floor may be altered. Adjustability of the incline or decline of the housing may be desired so that gravity may be used to provide additional resistance. For example, a user may desire to orient the housing at an incline during rowing exercises so that they are forced to translate the carriage up a slope to provide additional resistance.

The exercise apparatus of the present invention is configured to allow a user to perform multiple exercises in a compact form that may be easily stored, or integrated into articles of furniture. Referring to FIGS. 26-32 various embodiments of an integrated exercise apparatus will be described. As will be apparent, the exercise apparatus may be integrated into articles of furniture such as, for example, a sofa, a cabinet such as a dresser or a bed. The exercise apparatus may also be integrated into a structure such as a wall or closet space. It will be appreciated that numerous types of furniture may incorporate an exercise apparatus as described herein.

Referring to FIGS. 26-31, various exemplary embodiments of an integrated exercise system 400 in which an exercise apparatus is integrated into a sofa will be described. Integrated exercise system 400 generally includes concealment housing 402 that is used to conceal and store exercise apparatus 404. Concealment housing 402 is generally constructed as a sofa and includes a back 406, arms 408, a base 410 and seating cushions 412. In the present embodiment, back 406, arms 408 and cushions 412 may be constructed in any way known in the art. Exercise system 400 is constructed so that a person may sit or lie on the system as they would a traditional sofa.

Figure 27:
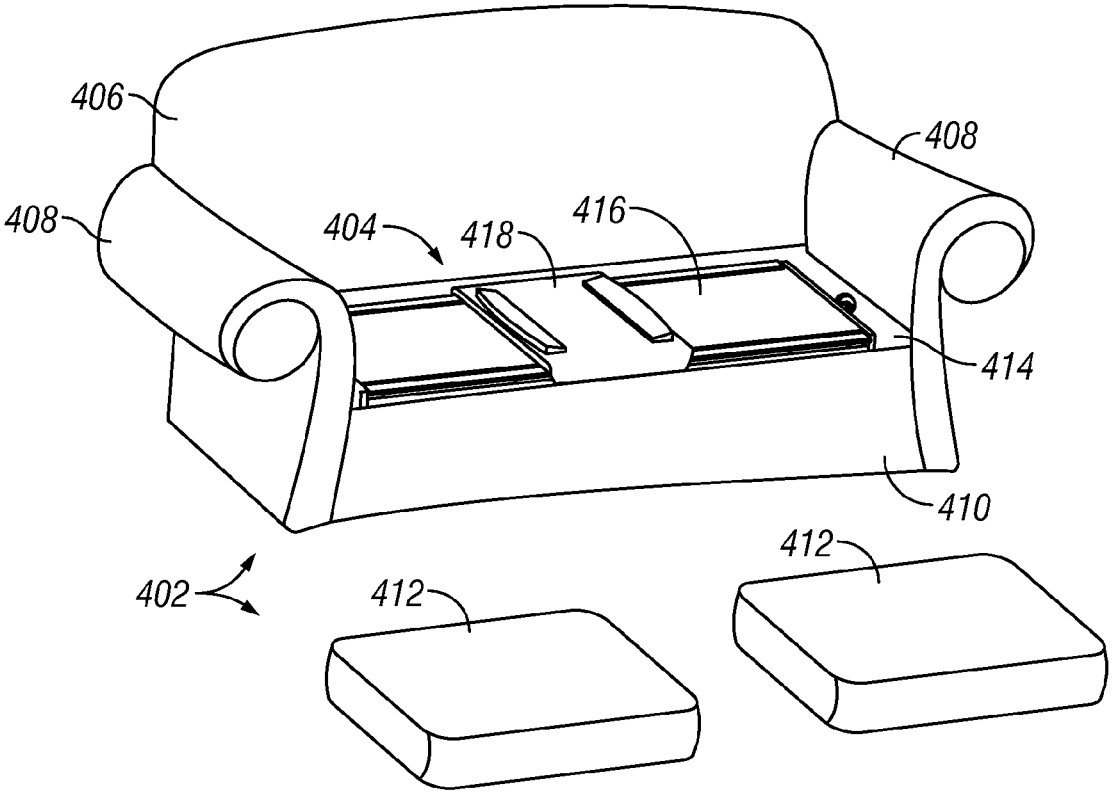
FIG. 27 is another perspective view of the embodiment of FIG. 26 in an open configuration.

Base 410, however, is constructed to receive and conceal exercise apparatus 404. Referring to FIG. 27, base is constructed so that it provides a cavity 414 that is open and accessible when cushions 412 are removed. Cavity 414 is sized so that exercise apparatus 404 may be lowered into cavity 414 and concealed by placing cushions 412 over exercise apparatus 404. It should be appreciated that alternatively, exercise system 400 may be configured so that a user may exercise without removing exercise apparatus 404 from base 410.

Preferably, base 410 includes a removable cover (not shown) that may be placed over cavity 414 to provide a surface for placement of cushions 412. The cover may be used so that the sofa may be configured for seating regardless of the presence of exercise apparatus 404 within cavity 414. The cover may be removable or it may be hinged to provide access to cavity 414.

Alternatively, an access panel (not shown) may also, or alternatively, be provided so that cavity 414 may be accessed through any side of base 410. For example, a removable or hinged access panel may be included on the front or rear vertical sidewall of base 410 so that exercise apparatus 404 may be removed from concealment housing 402 by sliding it out of cavity 414 after opening the access panel. As a further alternative, one or both arms 408 may include an access panel that allows similar access to exercise apparatus 404.

An advantage of providing a side access panel is that the user is not required to lift exercise apparatus from cavity 414 in those systems that require removal of exercise apparatus 404 from base 410. Instead, exercise apparatus 404 may be removed from cavity 414 by sliding or rolling exercise apparatus 404 relative to concealment housing 402. It should be appreciated that translation members may be included on exercise apparatus 404 that permit translation of the apparatus by sliding or rolling, such as low friction rails, rollers or casters. Alternatively, exercise apparatus 404 may be coupled to base 410 via gliding or rolling tracks that allow relative movement between base 410 and exercise apparatus 404.

Exercise apparatus 404 may be any exercise apparatus, such as the embodiments described above that provide compact storage and allow a user to perform multiple exercises. As shown in FIG. 27, exercise apparatus 404 is substantially identical to exercise apparatus 10 described above. Exercise apparatus generally includes housing 416 that contains a resistance assembly that provides resistance to a user manipulating a grip device or carriage 418. As described above, housing 416 of exercise apparatus 404 may be sized to receive vertical and/or horizontal support members and/or grip devices therein for storage.

Figure 28:
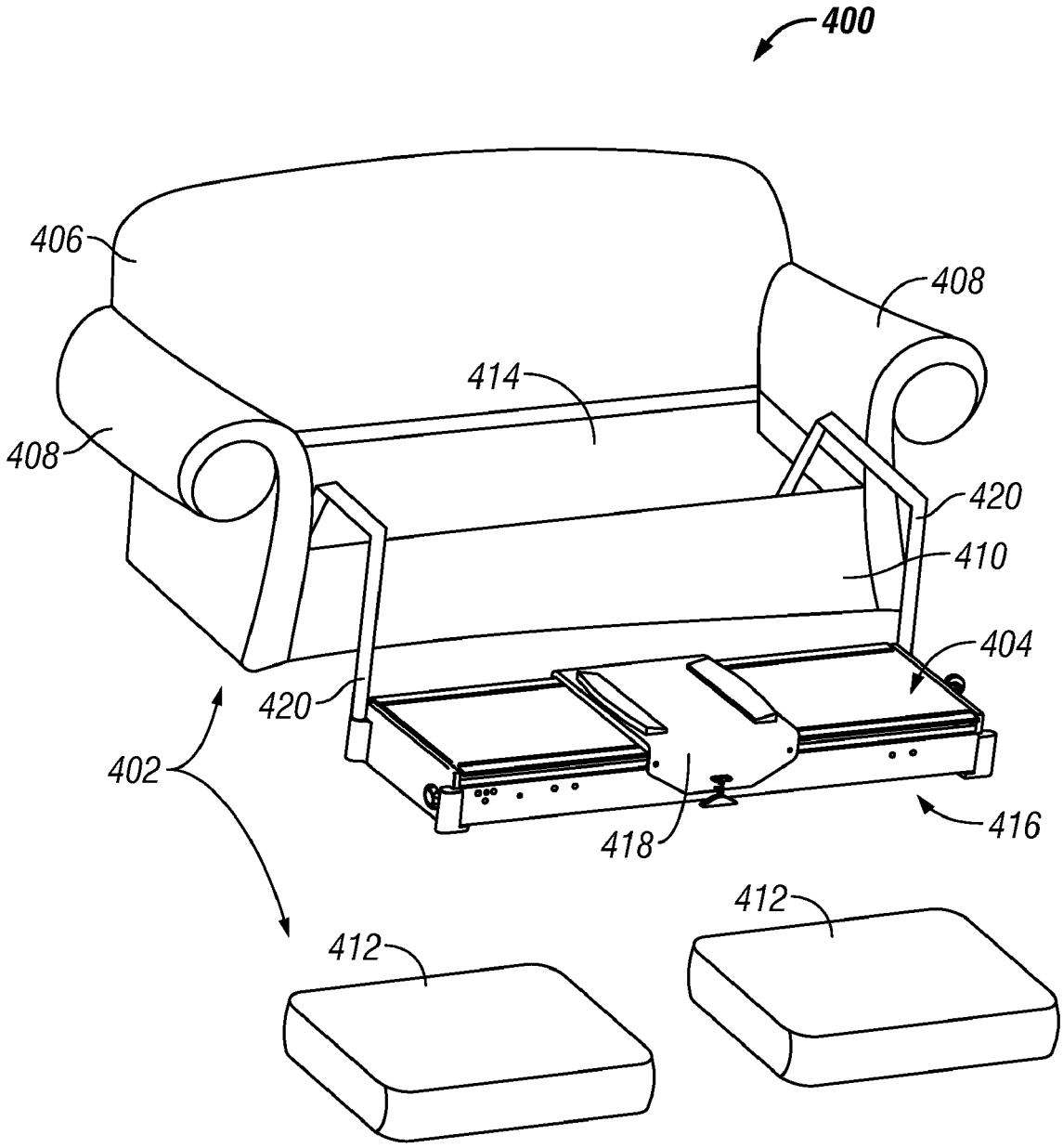
FIG. 28 is a perspective view of another embodiment of an integrated exercise system in which an exercise apparatus is integrated into a sofa in an open configuration in accordance with the present invention.

In another embodiment of integrated exercise system 400, shown in FIG. 28, exercise apparatus 404 may be coupled to concealment housing 402 via a linkage 420. Linkage 420 is configured to assist a user in retrieving exercise apparatus 404 from cavity 414. Linkage preferably includes spring members to provide the user with mechanical advantage to more easily lift exercise apparatus 404 from cavity 414. It should be appreciated that exercise apparatus 404 may be removable from linkage 420 if desired so that after retrieval of exercise apparatus 404 from cavity 414 it may be moved independently of concealment housing 402. As a further alternative, linkage may be motor driven and electronic controls may be provided so that exercise apparatus 404 may be retrieved from cavity 414 merely by operating the electronic controls.

Figure 29:
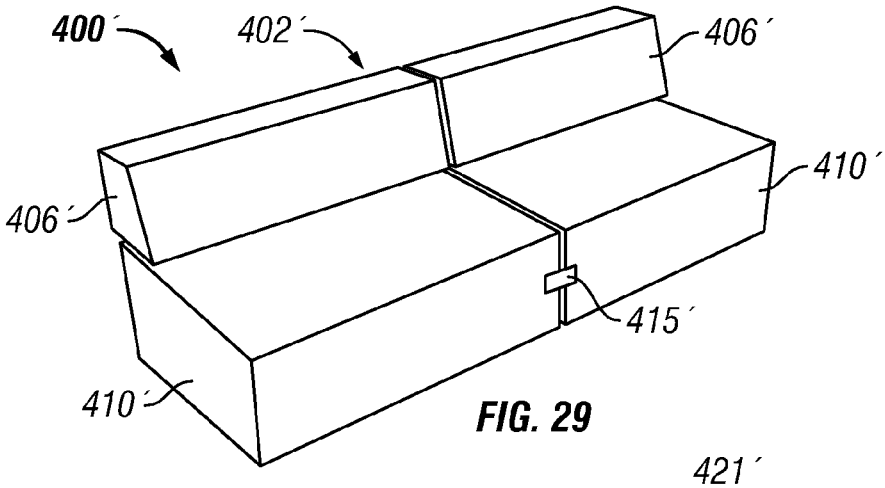
FIG. 29 is a perspective view of another embodiment of an integrated exercise system in which an exercise apparatus is integrated into a sofa in a closed configuration in accordance with the present invention.
Figure 30:
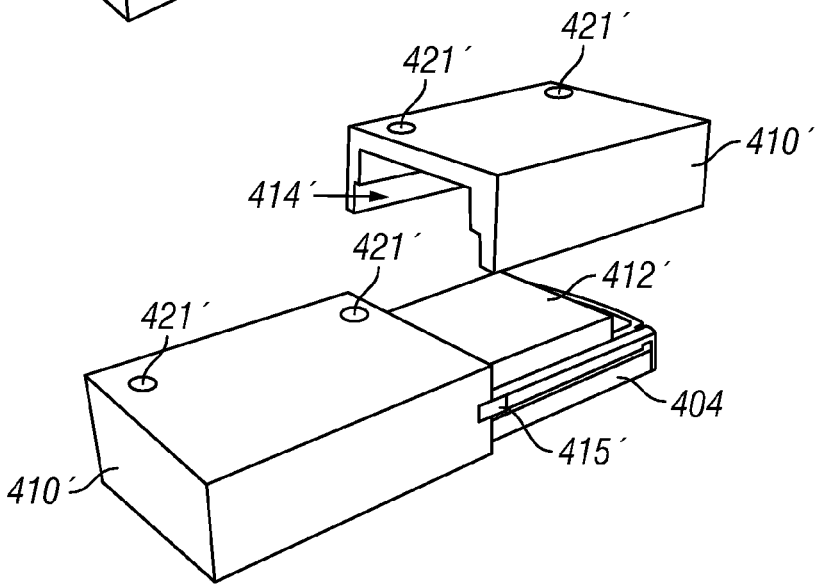
FIG. 30 is another perspective view of the embodiment of FIG. 29 in a partially open configuration.
Figure 31:
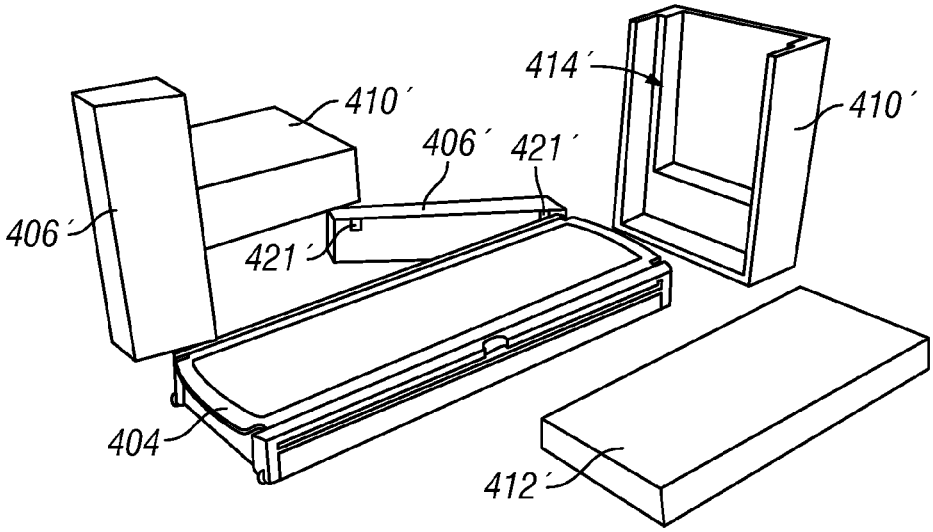
FIG. 31 is another perspective view of the embodiment of FIG. 29 in an open configuration.

Referring to FIGS. 29-31, another embodiment of the integrated exercise system will be described. Similar to the previously described embodiments, integrated exercise system 400' includes concealment housing 402' that is generally constructed as a sofa and is used to conceal and store exercise apparatus 404. Concealment housing 402' is constructed so that it may be assembled over exercise apparatus 404 when it is desired to conceal exercise apparatus 404. When a user desires to exercise, concealment housing 402' is disassembled and removed from exercise apparatus 404. Concealment housing 402' generally includes a pair of back members 406', a pair of base members 410' and cushion 412'.

Base members 410' combine to form a cavity 414' that is sized to receive exercise apparatus 404 and cushion 412' that is disposed on a top surface of exercise apparatus 404. Each base member 410' is separately placed over exercise apparatus 404 and after both base members 410' are properly positioned, base members 410' may be coupled with coupling member 415' so that they do not separate. For example, coupling member 415' may be a strip of hook and loop fastener material.

In the present embodiment, base members 410' provide a seating surface. In particular, the seating portions of base members 410' may be formed of a resilient material that provides cushioning. In addition, in the assembled system 400' cushion 412' is disposed below the seating portions of base members 410' and may be constructed of resilient material to provide additional cushioning. It should be appreciated that base members 410' may alternatively be constructed so that base members 410' provide a support surface for cushion 412' so that cushion 412' may be placed on top of base members 410'. As a further alternative, base members 410' may be substituted with a single base unit or more than two base members 410' may be provided and combined to form the base.

Back members 406' are removably coupled to base members 410' to provide a back rest portion of concealment housing 402'. Back members 406' may be constructed as rigid or semi-rigid structures and preferably include resilient back rest portion. Back members 406' may include one or more coupling members so that back members 406' may be coupled to base members 410'. Back members 406' may be removably coupled to base members 410' using fasteners 421', such as hook and loop tabs.

Exercise apparatus 404 may be accessed by disassembling concealment housing 404'. In the stored configuration, integrated exercise system 400' is configured as shown in FIG. 29 in which exercise apparatus 404 is concealed within concealment housing 402' which is assembled as a sofa. When a user desires to use exercise apparatus 404, they remove back members 406' and disassemble base members 410' as shown in FIG. 30. After base members 410' are disassembled and removed, cushion 412' is removed. As shown in FIG. 31, after back members 406', base members 410' and cushion 412' are removed, exercise apparatus 404 is accessible.

Figure 32:
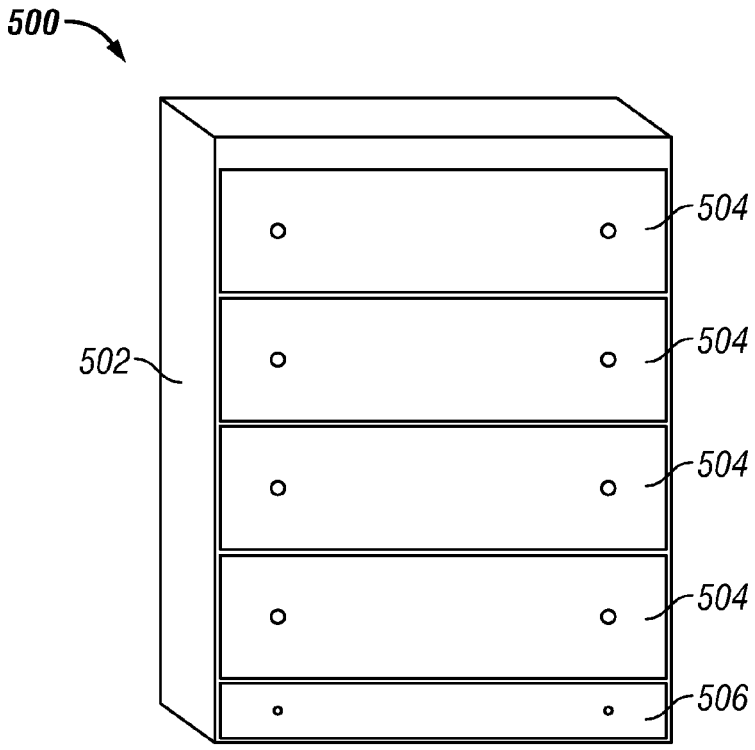
FIG. 32 is a perspective view of an embodiment of an integrated exercise system in which an exercise apparatus is integrated into a dresser in a closed configuration in accordance with the present invention.

Another embodiment of an integrated exercise system 500 will be described with reference to FIGS. 32 and 33. Integrated exercise system 500 comprises a concealment housing, e.g., dresser body 502, and a plurality of drawers 504. Drawers 504 provide storage as with a traditional drawer. Exercise apparatus 506 may be disposed in a cavity 510 defined by dresser body 502 in place of a drawer 504 or inside of a drawer 504. In a preferred embodiment, exercise apparatus 506 is stored and concealed within cavity 510 located in a bottom portion of dresser body 502 and a facade that resembles the faces of drawers 504 is attached to a side panel of exercise apparatus 506.

Figure 33:
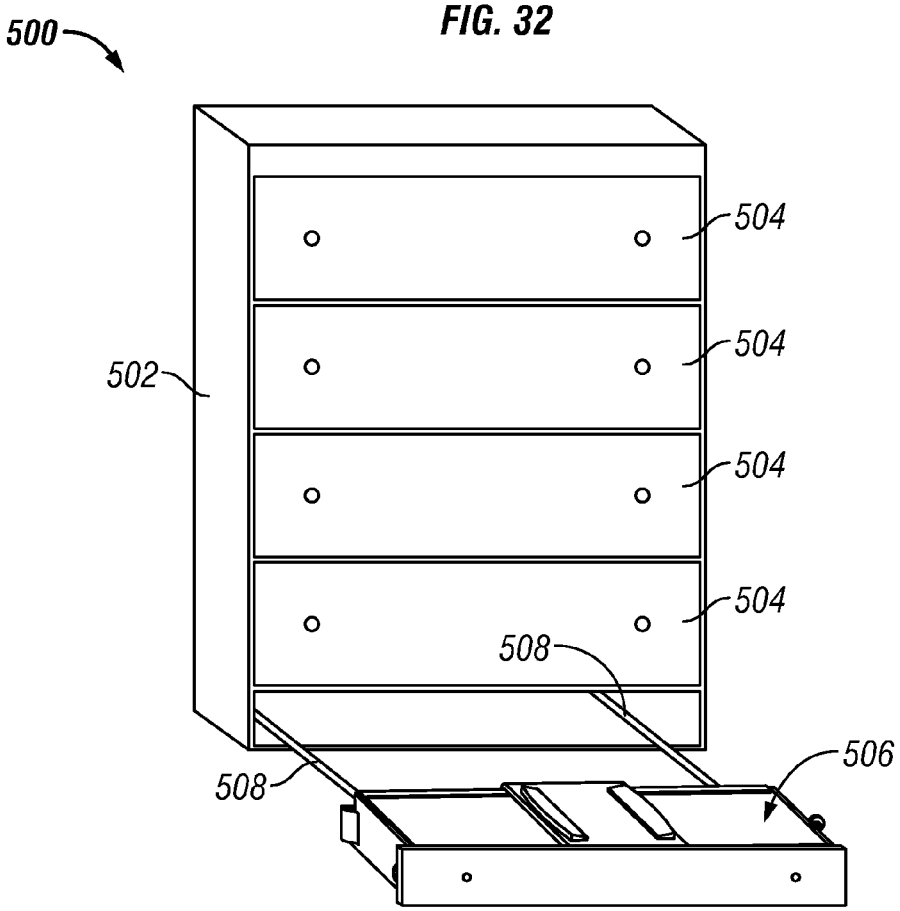
FIG. 33 is a perspective view of the embodiment of FIG. 32 in an open configuration.

Exercise apparatus 506 may be coupled to dresser body 502 by gliding or rolling tracks 508 so that it may be slid out of dresser body 502 easily by a user, as shown in FIG. 33. Exercise apparatus 506 may also be removable from tracks 508 if desired. Tracks 508 may be configured to prevent unintended movement of exercise apparatus 506 relative to dresser body 502 by providing a lock, latch or brake mechanism. It should be appreciated that dresser body 502 and exercise apparatus 506 need not be directly coupled and cavity 510 may be provided in any portion of dresser body 502. Once removed, exercise apparatus 506 may be operated to provide skiing, rowing, and weight training exercises.

It should be appreciated that the exercise apparatus may be incorporated into a bed frame in a similar fashion. In particular, a bed frame may be configured so that it defines a cavity that is sized to receive an exercise apparatus like those described above. When a user desires to exercise, the exercise apparatus may be slid or rolled from the cavity and used.

Figure 34:
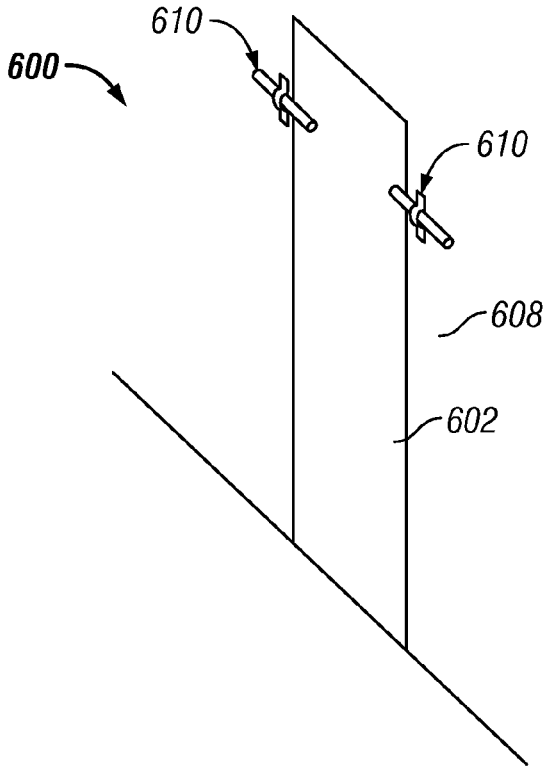
FIG. 34 is a perspective view of a wall-mounted embodiment of an integrated exercise apparatus in a closed configuration in accordance with the present invention.
Figure 35:
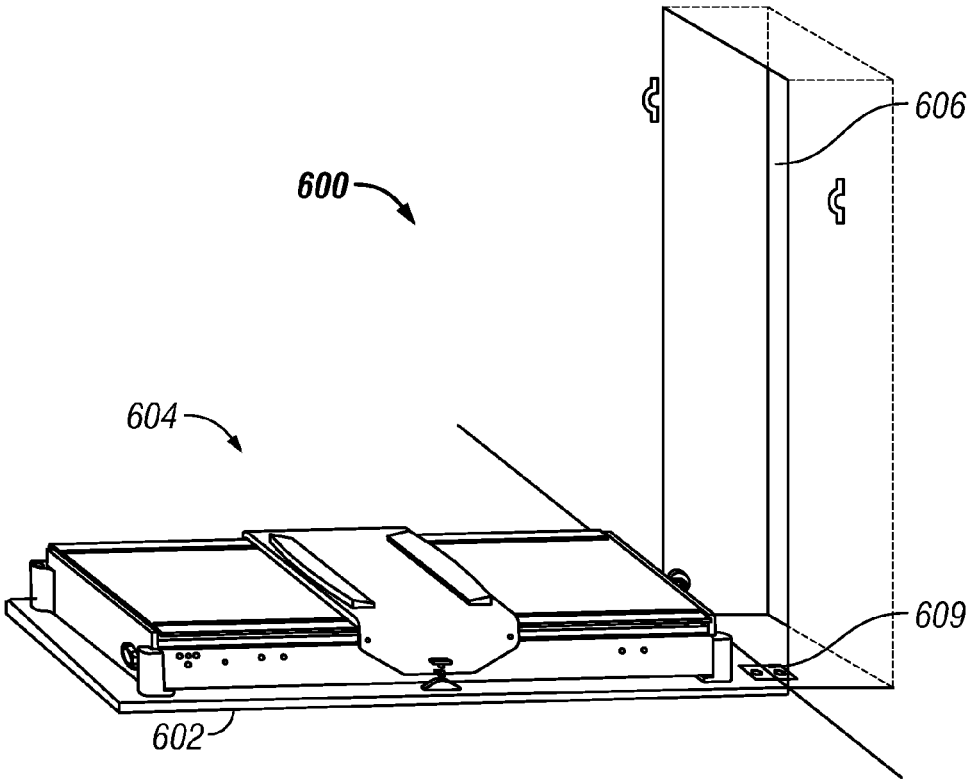
FIG. 35 is a perspective view of the embodiment of FIG. 34 in an open configuration.

Referring to FIGS. 34 and 35, integrated exercise system 600 includes a concealment housing, which provides a concealment cavity 606 and is mounted in a wall, wall panel 602 and exercise apparatus 604. Exercise apparatus 604 is coupled to wall panel 602 which is configured to pivot between an upright position and a horizontal position. Wall panel 602 is configured to cover cavity 606, which is provided in a structure, such as wall 608. It should be appreciated that the concealment housing of the present embodiment may be a box that is pre-constructed and mounted in wall 608 or a portion of wall 608 may form it.

Wall panel 602 is generally a planar member that is sized to fit within an opening of cavity 606. Additionally, wall panel is connected to the floor with hinges 609 or other pivoting members so that wall panel 602 may be pivoted from the upright position in which the attached exercise apparatus 604 is concealed in cavity 606 to a horizontal position on the floor in which exercise apparatus 604 is positioned for use. Alternatively, exercise apparatus 604 may be removed from wall panel 602 prior to use. Preferably, wall panel 602 includes locking members so that it may be locked in the upright position. The locking members may be sliding or pivoting latches or any other locking member known in the art.

In a still further embodiment, a door may be coupled to the wall to enclose the cavity so that it opens and closes as a conventional door and the exercise apparatus may be separately mounted in the cavity so that it may be moved between an upright concealed position and a horizontal use position. In such an embodiment, exercise apparatus may be mounted on a linkage that allows that movement and the linkage may be manually operated or motorized.

The above embodiments are examples of integrated exercise systems that incorporate an exercise apparatus with other household objects or structures. In this manner, an exercise apparatus may share space with, or be incorporated into, other pieces of furniture or structures, thereby providing a person with a system for exercising that does not take up a significant amount of volume. Although several examples have been described above, it will be appreciated that other pieces of furniture or other configurations may be used to accomplish the same result. It is an object of the present invention to include such systems within the scope of the present invention.

Thus, it is seen that an exercise system is provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. An exercise apparatus comprising:

a housing;

a resistance assembly including a resistance cable, the resistance assembly disposed within the housing; and a tension adjustment member disposed within the housing, wherein the tension adjustment member interfaces with the resistance assembly and is movable between a first position and a second position, wherein in the resistance assembly has a first geometry that corresponds to the first position of the tension adjustment member and a second geometry that corresponds to the second position of the tension adjustment member, wherein:

in the first position the tension adjustment member has a first neutral position at or near one end of its range of travel such that the resistance cable is actuated; and in the second position the tension adjustment member has a second neutral position near the center of its range of travel such that when the tension adjustment member is moved out of the second neutral position the resistance assembly induces the tension adjustment member back to the second neutral position.

2. The exercise apparatus of claim 1 further comprising a grip device coupled to the tension adjustment member.

3. The exercise apparatus of claim 2, wherein the resistance assembly includes a tension transmission member and a spring configured to preload the tension transmission member, and wherein the tension adjustment member contacts a portion of the tension transmission member such that the tension transmission member is in a Y-shaped configuration.

4. The exercise apparatus of claim 1 further comprising a carriage removably coupled to the tension adjustment member.

5. The exercise apparatus of claim 4, wherein the resistance assembly includes a tension transmission member and a spring configured to preload the tension transmission member, and wherein the tension adjustment member contacts a portion of the tension transmission member such that the tension transmission member is in an X-shaped configuration.

6. The exercise system of claim 1 wherein the tension adjustment member includes a contact surface that contacts a tension transmission member included in the resistance assembly, and wherein the contact surface is included on a pulley that is mounted on the tension adjustment member.

7. The exercise system of claim 1 wherein the resistance assembly includes a tension transmission member and a spring configured to preload the tension in the tension transmission member, and an adjustment mechanism coupled to the spring such that the preload may be adjusted.

8. The exercise system of claim 7 wherein the spring is a torsion spring having a first end coupled to a rotatable support assembly and a second end coupled to the adjustment mechanism.

9. The exercise system of claim 8 wherein the first end of the torsion spring is coupled to the rotatable support assembly by a linkage.

10. The exercise system of claim 8 wherein the tension transmission member is coupled to a disk disposed on the rotatable support assembly.

11. An apparatus providing resistance to motion comprising:

means for interfacing a tension adjustment member with a resistance assembly, the resistance assembly including a resistance cable and having a first geometry and a second geometry;

means for configuring the tension adjustment member so that it has a first position and a second position such that in the first position the tension adjustment member has a first neutral position at or near one end of its range of travel such that the resistance cable is actuated and in the second position the tension adjustment member has a second neutral position near the center of its range of travel such that when the tension adjustment member is moved out of the second neutral position the resistance assembly induces the tension adjustment member back to the second neutral position, the first position corresponding to the first geometry and the second position corresponding to the second geometry;

means for applying a first force on the tension adjustment member from the first position and applying a second force on the tension adjustment member from the second position, the first force having a different magnitude than the second force.

12. The apparatus of claim 11 wherein the resistance assembly includes tension transmission member, further comprising a means for preloading the tension transmission member using a spring.

13. The apparatus of claim 12 further comprising a means for contacting a portion of the tension transmission member with a contact surface of the tension adjustment member such that the tension transmission member is in a Y-shaped configuration.

14. The apparatus of claim 12 further comprising a means for contacting a portion of the tension transmission member with a contact surface of the tension adjustment member such that the tension transmission member is in an X-shaped configuration.

15. The apparatus of claim 11 further comprising:

means for contacting a portion of a tension transmission member with a contact surface of the tension adjustment member, wherein the contact surface is included on a pulley; and means for mounting the pulley on the tension adjustment member.

16. The apparatus of claim 12 wherein an adjustment mechanism is coupled to the spring and further comprising adjusting the preload using the adjustment mechanism.

17. The apparatus of claim 12 wherein the spring is a torsion spring having a first end coupled to a rotatable support assembly and a second end coupled to the adjustment mechanism.

18. The apparatus of claim 17 wherein the first end of the torsion spring is coupled to the rotatable support assembly by a linkage.

19. The apparatus of claim 17 wherein the tension transmission member is coupled to a disk disposed on the rotatable support assembly.

20. An exercise apparatus comprising:

a housing;

a resistance assembly including a resistance cable, the resistance assembly disposed within the housing; and a tension adjustment member disposed within the housing, wherein the tension adjustment member interfaces with the resistance assembly and is movable between a first position and a second position; and wherein:

in the first position the tension adjustment member has a first neutral position at or near one end of its range of travel such that the resistance cable is actuated; and in the second position the tension adjustment member has a second neutral position near the center of its range of travel such that when the tension adjustment member is moved out of the second neutral position the resistance assembly induces the tension adjustment member back to the second neutral position.

* * * * *